US008746754B2

(12) United States Patent
Shute et al.

(10) Patent No.: US 8,746,754 B2
(45) Date of Patent: Jun. 10, 2014

(54) LOCKING DEVICE FOR TOTE BIN

(75) Inventors: Matthew R. Shute, Charlotte, NC (US); William Jacob Kozlowski, Jr., Tega Cay, SC (US)

(73) Assignee: Checkpoint Systems, Inc., Thorofare, NJ (US)

( * ) Notice: Subject to any disclaimer, the term of this patent is extended or adjusted under 35 U.S.C. 154(b) by 1116 days.

(21) Appl. No.: 12/630,372

(22) Filed: Dec. 3, 2009

(65) Prior Publication Data

US 2010/0133126 A1 Jun. 3, 2010

Related U.S. Application Data

(60) Provisional application No. 61/119,667, filed on Dec. 3, 2008, provisional application No. 61/144,306, filed on Jan. 13, 2009.

(51) Int. Cl.
*E05C 1/02* (2006.01)

(52) U.S. Cl.
USPC ..... 292/137; 292/141; 292/151; 292/319; 292/321

(58) Field of Classification Search
USPC ..... 292/137, 141, 151, 318–321
See application file for complete search history.

(56) References Cited

U.S. PATENT DOCUMENTS

| | | | | |
|---|---|---|---|---|
| 2,113,306 | A * | 4/1938 | Martinez et al. | 292/307 R |
| 3,265,426 | A * | 8/1966 | Brooks et al. | 292/307 R |
| 4,453,636 | A | 6/1984 | Meadows et al. | |
| 4,782,977 | A * | 11/1988 | Watanabe et al. | 220/324 |
| 6,328,356 | B1 * | 12/2001 | Aichmann | 292/318 |
| 6,513,842 | B1 * | 2/2003 | Fuehrer | 292/307 R |
| 6,832,498 | B2 | 12/2004 | Belden, Jr. et al. | |
| 6,880,717 | B1 * | 4/2005 | O'Conor | 220/318 |
| 6,920,769 | B2 | 7/2005 | Huehner | |
| 7,007,523 | B2 | 3/2006 | Belden, Jr. | |
| 7,162,899 | B2 | 1/2007 | Fawcett et al. | |

(Continued)

FOREIGN PATENT DOCUMENTS

| | | |
|---|---|---|
| FR | 2 862 999 A1 | 6/2005 |
| JP | 2000 238817 | 9/2000 |

(Continued)

OTHER PUBLICATIONS

International Search Report and Written Opinion for International Application No. PCT/US2009/066572, mailed Nov. 8, 2010.

(Continued)

*Primary Examiner* — Mark Williams
(74) *Attorney, Agent, or Firm* — Nathaniel T. Quirk

(57) ABSTRACT

A locking device is provided for locking a container having sidewalls and at least one lid defining an open position and a closed position. The locking device may include an elongate lock member configured to engage the lid(s) and a lock housing that is associated with at least one of the sidewalls. The lock housing may be configured to at least partially receive the elongate lock member. The locking device may be designed to be installed on the container in the field, or the locking device may be integrally formed with the container. The lock housing may include a security element that is detectable by a security system to guard against theft of the container. In some cases, a security module is provided that releasably attaches to the lock housing to provide further alarm functionality.

39 Claims, 38 Drawing Sheets

(56) References Cited

U.S. PATENT DOCUMENTS

| | | | | |
|---|---|---|---|---|
| 7,239,238 | B2 * | 7/2007 | Tester et al. | 340/539.31 |
| 7,249,401 | B2 | 7/2007 | Copen et al. | |
| 7,259,674 | B2 | 8/2007 | Marsilio et al. | |
| 7,266,979 | B2 | 9/2007 | Belden, Jr. | |
| 7,438,198 | B2 * | 10/2008 | Pickles | 220/324 |
| 7,474,209 | B2 | 1/2009 | Marsilio et al. | |
| 7,497,101 | B2 | 3/2009 | Fawcett et al. | |
| 7,866,505 | B2 * | 1/2011 | Perlman et al. | 220/835 |
| 8,128,145 | B2 * | 3/2012 | Smith et al. | 296/29 |
| 2003/0145441 | A1 | 8/2003 | Andersson et al. | |
| 2003/0160697 | A1 | 8/2003 | Sedon et al. | |
| 2006/0081020 | A1 | 4/2006 | Hsiao et al. | |
| 2006/0145848 | A1 | 7/2006 | Marsilio et al. | |
| 2006/0170550 | A1 | 8/2006 | Marsilio et al. | |
| 2007/0120669 | A1 | 5/2007 | Belden, Jr. | |

FOREIGN PATENT DOCUMENTS

| | | | |
|---|---|---|---|
| WO | WO 2004/018811 | A1 | 3/2004 |
| WO | WO 2006/076348 | A2 | 7/2006 |
| WO | WO 2006/081650 | A1 | 8/2006 |
| WO | WO 2007/142595 | A1 | 12/2007 |

OTHER PUBLICATIONS

Invitation to Pay Additional Fees issued in connection with International Application No. PCT/US2009/066572 and mailed on Apr. 1, 2010.

* cited by examiner

LOCKING DEVICE FOR TOTE BIN

CROSS-REFERENCE TO RELATED APPLICATIONS

This application claims the benefit of U.S. Provisional Application No. 61/119,667, filed on Dec. 3, 2008 and U.S. Provisional Application No. 61/144,306, filed on Jan. 13, 2009, the contents of each of which are incorporated herein by reference in their entirety.

BACKGROUND

Many people find tote bins to be useful for storing, shipping, and handling material. For example, tote bins can be used to hold personal items, retail products, and other articles that may need to be secured. Tote bins are typically made of molded plastic to provide a light-weight container.

In general, tote bins include a cover to keep articles inside the tote bin and to keep dust, dirt, and moisture out. The cover may be a single molded plastic lid that is separate from the tote bin and snaps on to the sides of the container to close. In this case, the lid can be removed by flexing portions of the lid to disengage the lid from the rest of the tote bin. Some tote bins include a cover that is connected to part of the container via a hinge that allows the lid to remain attached to the tote bin even in the open position.

Often times, tote bins are used for holding items that the owner wishes to keep safe. For example, the owner may place valuable merchandise or personal belongings in the tote bin that he wishes to safeguard from shoplifters or thieves. As another example, the owner may place potentially harmful or dangerous items in the tote bin that he wishes to keep away from curious children or pets, such as paint, household cleaners, or other chemicals.

Applicant has discovered that it would be desirable to provide devices and methods of reliably securing articles within tote bins in a way that does not add significantly to the cost or complexity of manufacture of the tote bin. As described in greater detail below, a variety of challenges were identified and overcome through Applicant's efforts to invent and develop such a device.

BRIEF SUMMARY OF THE INVENTION

Devices and systems are therefore provided for providing a reliable and effective way to lock a tote bin or other similar container.

In some embodiments, a locking device for locking a container having sidewalls and at least one lid defining an open position and a closed position is provided. The locking device includes an elongate lock member configured to engage one of the at least one lid or at least one of the sidewalls and a lock housing associated with the other of the at least one lid or the at least one of the sidewalls. The lock housing is configured to at least partially receive the elongate lock member. The lock housing comprises a lock assembly defining a locked position, wherein, in the locked position, the lock assembly is configured to engage the elongate lock member and secure the at least one lid in the closed position, and further comprises a security element.

In some embodiments, the lock housing further comprises an audible alarm device, an energy source, and a sense loop configured to detect a fault condition associated with the locking device. The locking device may include a security module configured to be releasably attached to the lock housing, wherein the security module comprises an audible alarm device and an energy source.

In some cases, the elongate lock member defines a locking surface, and the lock assembly comprises a locking spring defining engaging ends that are biased to engage the locking surface of the elongate lock member. In other cases, the elongate lock member may define a locking surface, and the lock assembly may comprise a locking slider that is spring biased to engage the locking surface of the elongate lock member.

The elongate lock member may comprise a flexible cable defining a locking surface, and the lock assembly may be configured to engage the locking surface of the flexible cable when the lock assembly is in the locked position. Furthermore, the flexible cable may be movable from an extracted position to a retracted position, and the lock assembly may be configured to engage the locking surface of the flexible cable when the flexible cable is in the retracted position. A retraction force may be required to drive the flexible cable from the extracted position to the retracted position, and the flexible cable may define a driving element configured to be grasped by a user when applying the retraction force. At least one lid may comprise a cable retaining element configured to frictionally resist movement of the flexible cable from the extracted position to the retracted position, and the flexible cable may define a drive rigidity for reducing buckling of the flexible cable when the retraction force is applied.

In some cases, the container comprises a first lid and a second lid, and the elongate lock member is configured to engage and secure the first lid and the second lid in the closed position when the lock assembly is in the locked position. The elongate lock member may comprise a rigid member defining a locking surface, and the locking surface may comprise a protrusion, where the lock housing comprises a locking slider configured to engage the protrusion when the lock assembly is in the locked position. Further, the container may comprise a first lid and a second lid, and the elongate lock member may be configured to engage and secure the first lid and the second lid in the closed position when the lock assembly is in the locked position. The elongate lock member may be configured to remain with the first lid when the elongate lock member is in an extracted position and the first lid is in the open position.

In other embodiments, a locking device is provided for locking a container having sidewalls and at least one lid defining an open position and a closed position. The locking device comprises a latch pin configured to engage the at least one lid and defining a locking surface and a lock housing associated with at least one of the sidewalls, wherein the lock housing is configured to at least partially receive the latch pin. The lock housing comprises a locking slider defining a locked position and having an engagement surface, wherein the engagement surface is configured to engage the locking surface of the latch pin and secure the at least one lid in the closed position when the locking slider is in the locked position, and a security element.

The locking surface may comprise notches configured to engage the engagement surface of the locking slider. The locking slider may comprise a magnetic element that is moveable between the locked position and an unlocked position, and the magnetic element may be spring biased in the locked position. The magnetic element may be driven from the locked position to the unlocked position against the spring bias by positioning a magnetic key in magnetic proximity to the magnetic element. In some cases, the locking device further includes a frictional element configured to fit around the latch pin and to provide an interference fit between the latch pin and a hole defined by one of the at least one lid through which the latch pin passes. The frictional element may be configured to frictionally resist movement of the latch pin from an extracted position to a retracted position.

In still other embodiments, a locking device is provided for locking a container having sidewalls and at least one lid defining an open position and a closed position. The locking device comprises a flexible cable configured to engage the at least one lid and defining a locking surface and a lock housing associated with at least one of the sidewalls, wherein the lock housing is configured to at least partially receive the flexible cable. The lock housing comprises a locking slider defining a locked position and having an engagement surface, wherein the engagement surface is configured to engage the locking surface of the latch pin and secure the at least one lid in the closed position when the locking slider is in the locked position, and a security element.

The locking surface may comprise at least one ferrule configured to engage the engagement surface of the locking slider, and the locking slider may comprise a magnetic element that is moveable between the locked position and an unlocked position, wherein the magnetic element is spring biased in the locked position. The magnetic element may be driven from the locked position to the unlocked position against the spring bias by positioning a magnetic key in magnetic proximity to the magnetic element.

The flexible cable may be movable from an extracted position to a retracted position, and the lock assembly may be configured to engage the locking surface of the flexible cable when the flexible cable is in the retracted position. A retraction force may be required to drive the flexible cable from the extracted position to the retracted position, and the flexible cable may define a driving element configured to be grasped by a user when applying the retraction force. Further, the flexible cable may define a drive rigidity for reducing buckling of the flexible cable when the retraction force is applied.

In some cases, the locking device further comprises a guide element fixedly disposed within the at least one sidewall associated with the locking housing and at least partially surrounding the flexible cable when the flexible cable is in the retracted position. The guide element may be configured to direct the flexible cable towards the lock housing as the flexible cable is driven from the extracted position to the retracted position, and the guide element may be configured to shield at least part of the flexible cable when the flexible cable is in the retracted position.

In some embodiments, the at least one lid comprises a cable retaining element configured to frictionally resist movement of the flexible cable from an extracted position to a retracted position. The container may comprise a first lid and a second lid, and the flexible cable may be configured to engage and secure the first lid and the second lid in the closed position when the locking slider is in the locked position.

In still other embodiments, a locking device is provided for locking a container having sidewalls, a first lid, and a second lid, the first and second lids defining an open position and a closed position. The locking device comprises a locking extension extending from the first lid, the locking extension defining a locking surface, and a receiving cavity formed in the second lid, wherein the receiving cavity is configured to receive the locking extension as the first and second lids are moved from the open position to the closed position. The receiving cavity may comprise a locking spring defining engaging ends that are configured to engage the locking surface as the locking extension is received into the receiving cavity. In some cases, the locking surface comprises notches defined in the locking extension. Further, the locking extension may be configured to flex to accommodate an arcuate joining of the locking extension with the receiving cavity as the respective lids are moved from the open position to the closed position.

In still other embodiments, a locking device is provided for locking a container having sidewalls, a first lid, and a second lid, the first and second lids defining an open position and a closed position. The locking device comprises a locking plunger extending from the first lid, the locking plunger defining a locking surface, and a lock housing associated with the second lid. The lock housing comprises a locking shuttle defining an engagement surface configured to engage the locking surface, wherein the locking shuttle is configured to move between a locked position and an unlocked position. In the locked position the engagement surface is configured to engage the locking surface.

The locking shuttle may comprise a magnetic element that is moveable between the locked position and an unlocked position, wherein the magnetic element is spring biased in the locked position. The magnetic element may be driven from the locked position to the unlocked position against the spring bias by positioning a magnetic key in magnetic proximity to the magnetic element and moving the magnetic key in the direction of the unlocked position.

The locking plunger may comprise a shaft portion extending from the first lid and an enlarged portion disposed at an end of the shaft portion, wherein the enlarged portion comprises the locking surface. The engagement surface may comprise a locking aperture defined by the locking shuttle and may be configured to partially surround the shaft portion and engage the locking surface, thereby preventing passage of the enlarged portion through the locking aperture in the locked position. In some cases, the locking shuttle may comprise a tapered surface configured such that, when the locking shuttle is in the locked position and the first lid is moved to the closed position, the enlarged portion rides along the tapered surface and displaces the locking shuttle to allow the locking aperture to partially surround the shaft portion and engage the locking surface.

In still other embodiments, a locking device is provided for locking a container having sidewalls and at least one lid. The locking device comprises a connecting bar extending along the at least one lid between a first lock point of the container and a second lock point of the container and movable between an extracted position and a retracted position. The connecting bar comprises a first locking portion proximate the first lock point, a second locking portion proximate the second lock point, and a main portion extending between the first locking portion and the second locking portion, wherein the main portion defines a locking surface proximate the first lock point. The locking device also comprises a lock housing formed in the at least one lid proximate the first lock point, wherein the lock housing comprises a locking slider defining a locked position and including an engagement surface configured to engage the locking surface of the main portion when the locking slider in the locked position. Further, the container sidewalls define a first receiving cavity proximate the first lock point that is configured to receive the first locking portion and a second receiving cavity proximate the second lock point that is configured to receive the second locking portion substantially simultaneously with receipt of the first locking portion by the first receiving cavity when the connecting bar is in the retracted position.

In some cases, the locking surface comprises a notch defined by the main portion of the elongate lock member. The connecting bar may be configured to slide within a channel formed in the at least one lid between the retracted position and the extracted position. The connecting bar may also define a grasping portion between the main portion and the first locking portion configured to be grasped by a user such that a user can move the connecting bar between the retracted position and an extracted position. In some cases, only the grasping portion is accessible to the user when the connecting bar is in the retracted position.

BRIEF DESCRIPTION OF THE SEVERAL VIEWS OF THE DRAWING(S)

Reference will now be made to the accompanying drawings, which are not necessarily drawn to scale, and wherein.

DETAILED DESCRIPTION

Figure 1:
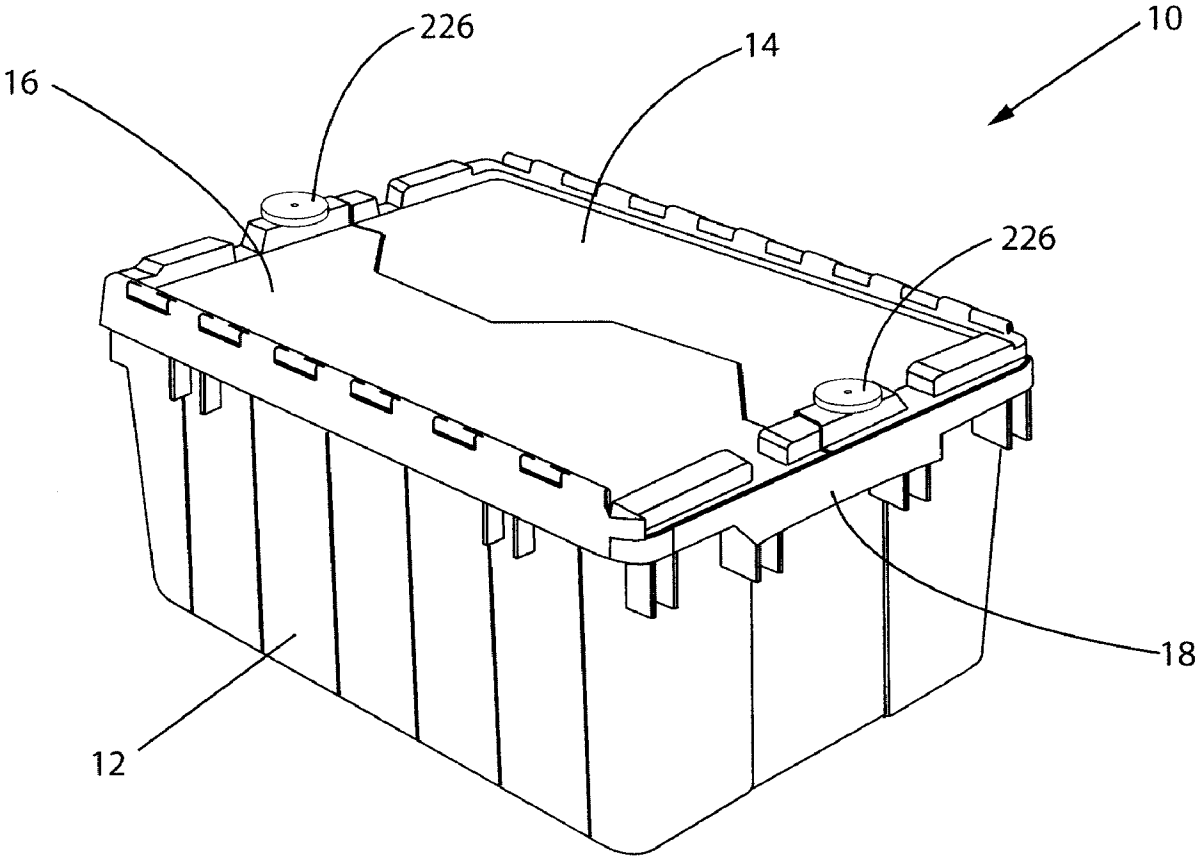
FIG. 1 illustrates a tote bin in accordance with one exemplary embodiment of the present invention.

Embodiments of the present invention now will be described more fully hereinafter with reference to the accompanying drawings, in which some, but not all embodiments are shown. Indeed, the invention may be embodied in many different forms and should not be construed as limited to the embodiments set forth herein; rather, these embodiments are provided so that this disclosure will satisfy applicable legal requirements. Like reference numerals refer to like elements throughout.

Figure 23:
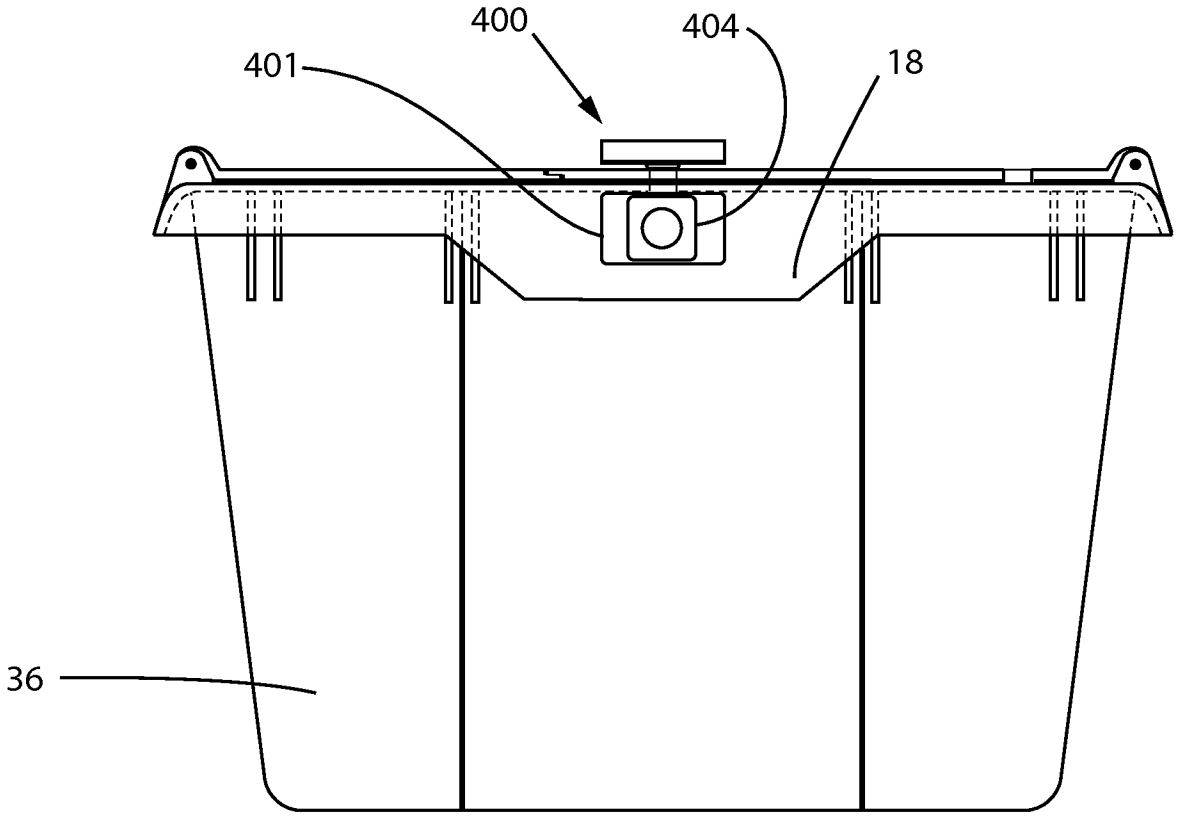
FIG. 23 illustrates a side view of a tote bin with an integral locking device in accordance with another exemplary embodiment.
Figure 24:
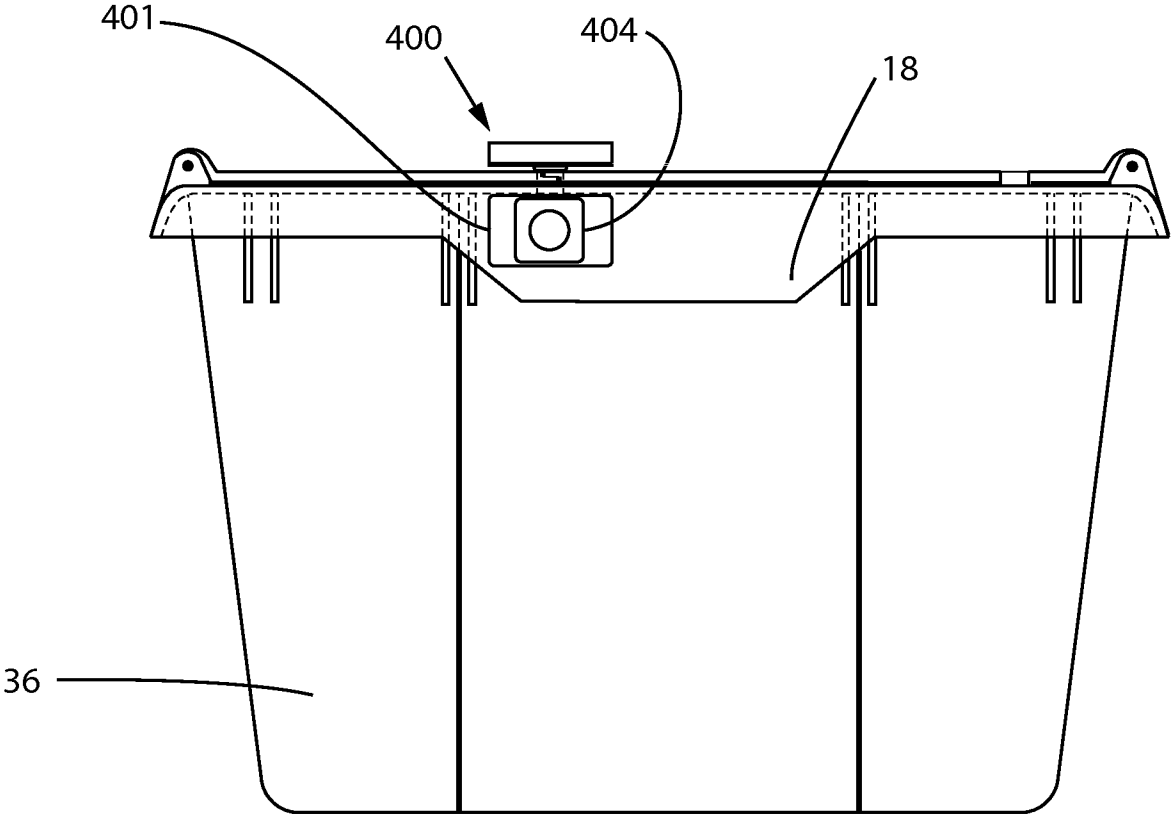
FIG. 24 illustrates a side view of a tote bin with an integral locking device in accordance with another exemplary embodiment.
Figure 25:
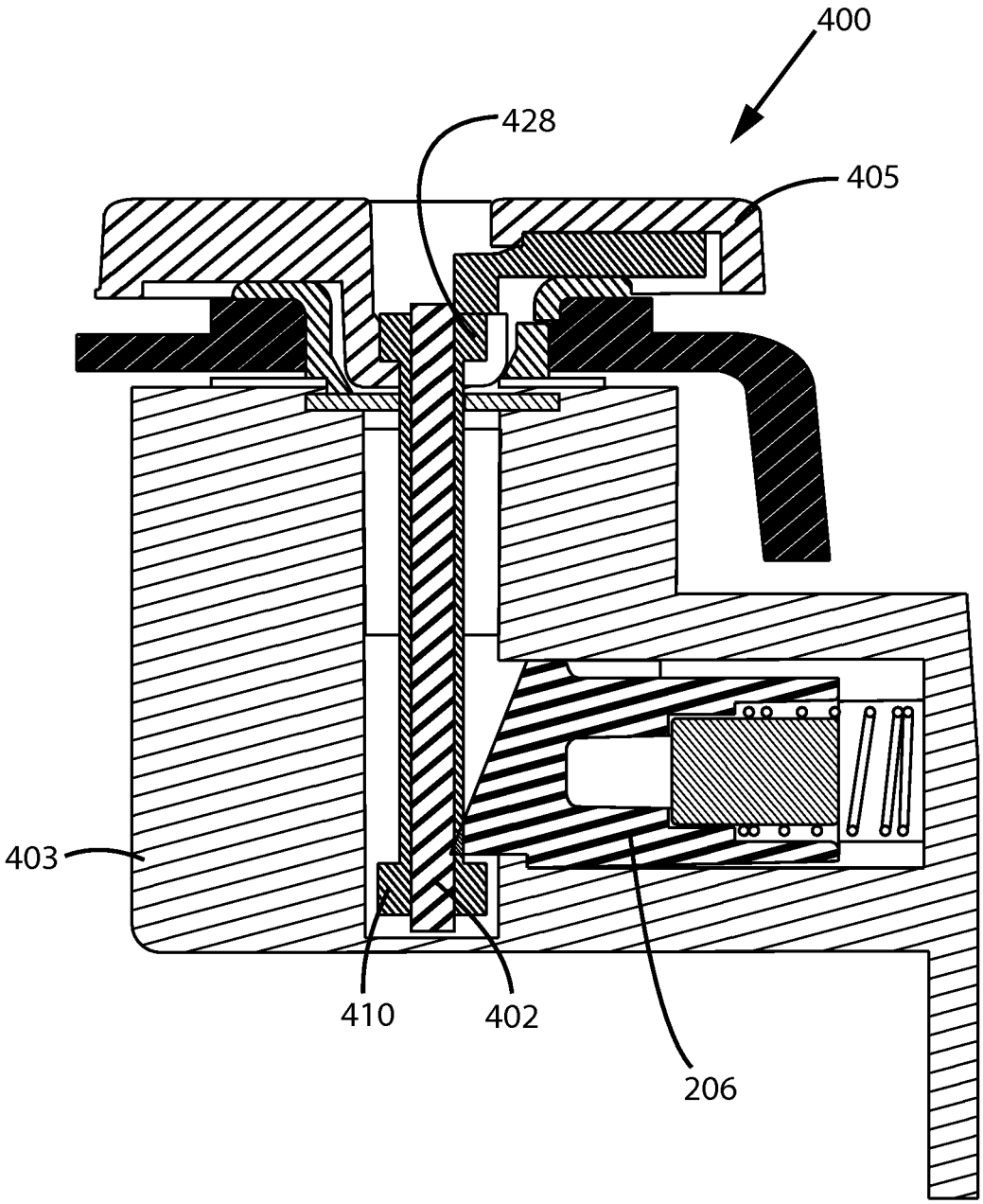
FIG. 25 is a cross-sectional detail view of the locking device of FIGS. 23 and 24.
Figure 26:
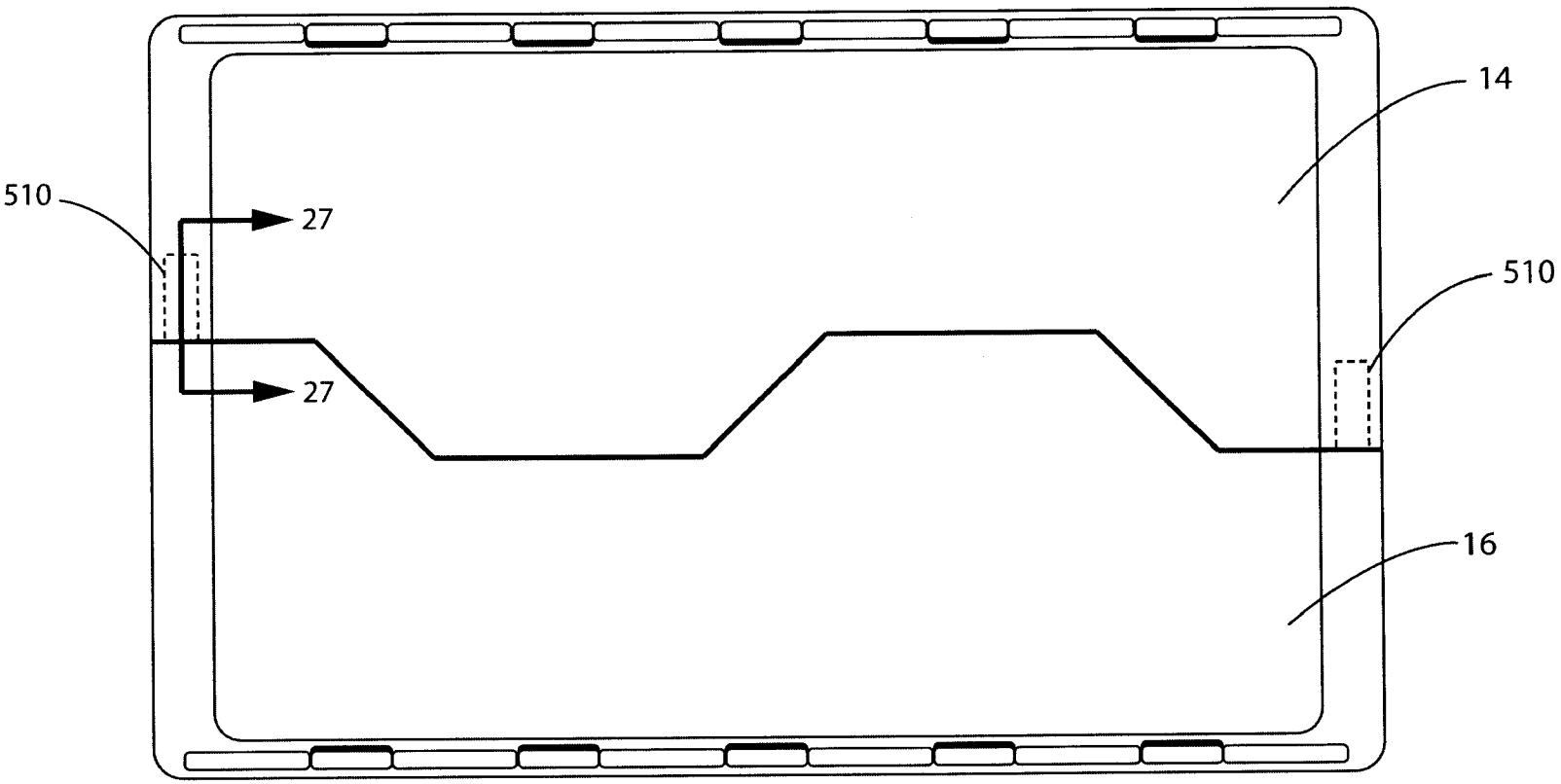
FIG. 26 illustrates a top view of a tote bin with an integral locking device in accordance with another exemplary embodiment.
Figure 27:
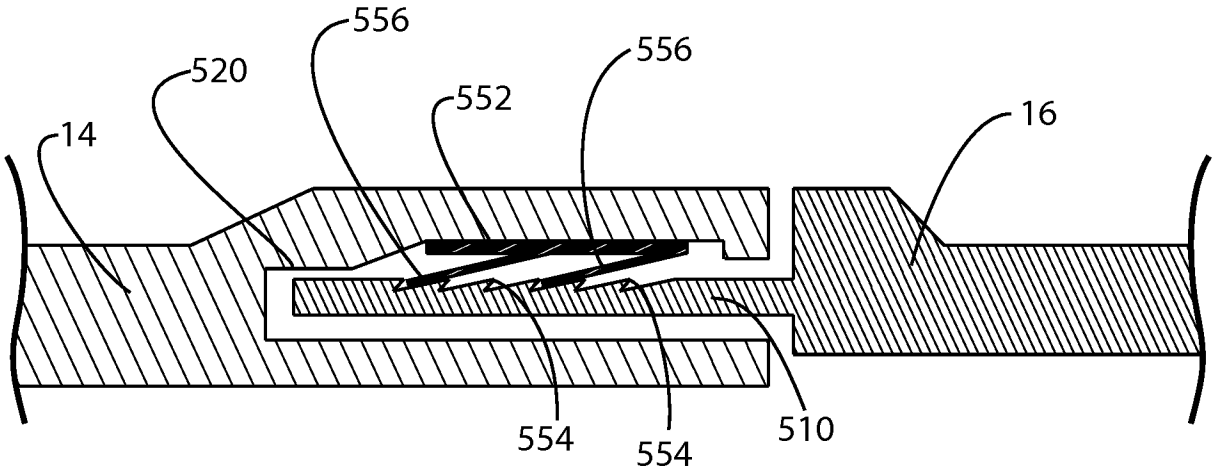
FIG. 27 is a cross-sectional detail view of the locking device of FIG. 26.
Figure 28:
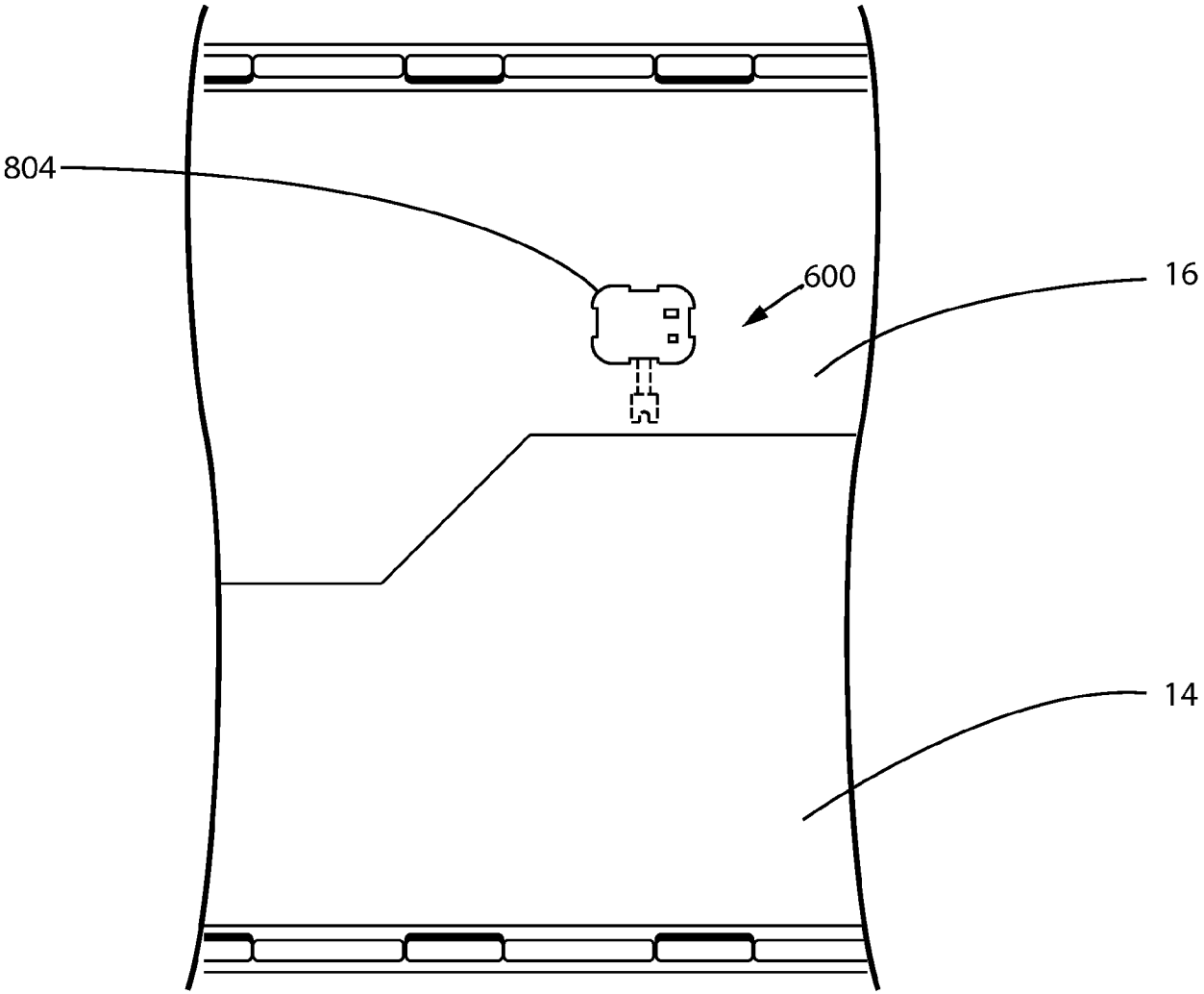
FIG. 28 illustrates a top view of a tote bin with an integral locking device in accordance with another exemplary embodiment.
Figure 29:
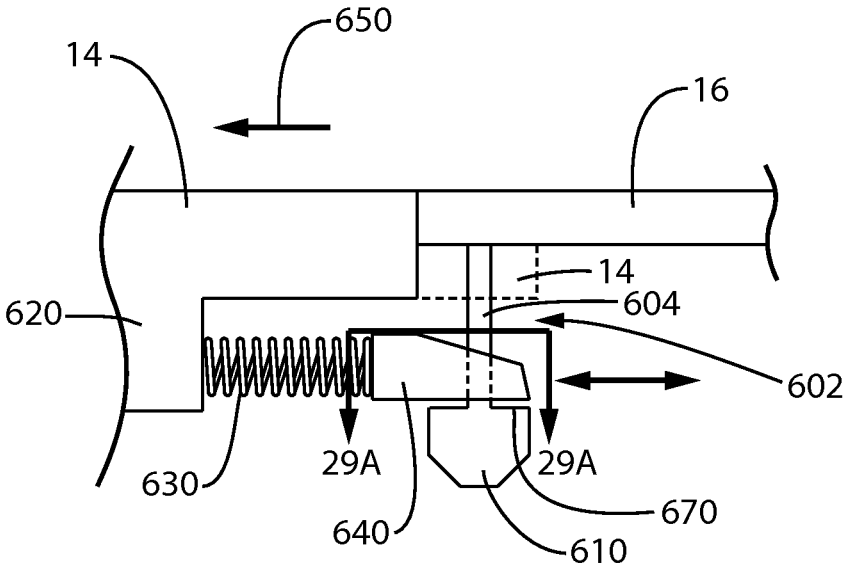
FIG. 29 is a side detail view of the locking device of FIG. 28 with the locking shuttle in the locked position.
Figure 30:
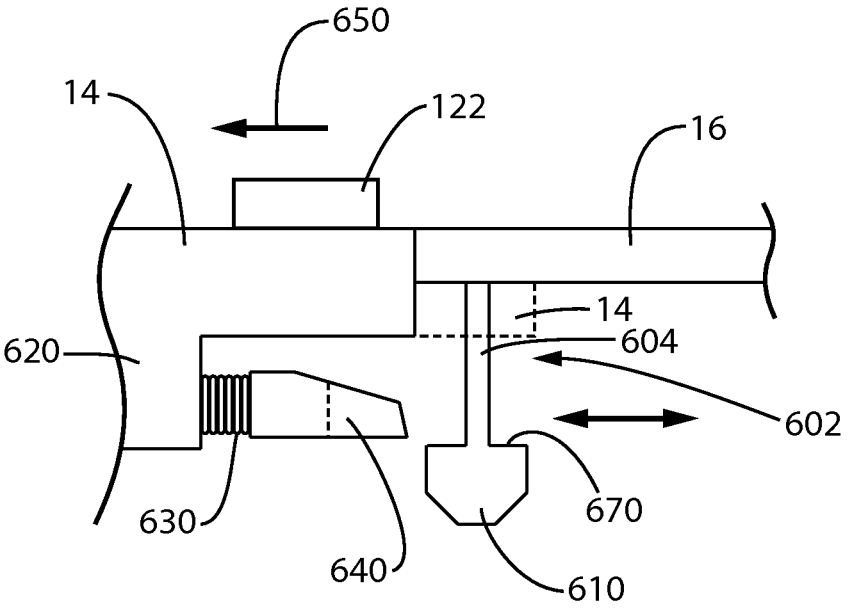
FIG. 30 is a side detail view of the locking device of FIG. 28 with the locking shuttle in the unlocked position.

Embodiments of the locking device described below provide a reliable and effective way to lock a tote bin or other similar container. In some embodiments, the locking device is integrally manufactured with the tote bin. For example, the locking device may be molded into the sidewalls and/or one or more of the lids of the tote bin at the same time that the tote bin is formed. In other embodiments, the locking device may be permanently or releasably attached to the tote bin. The description that follows outlines several exemplary embodiments. A first embodiment is shown in FIGS. 2-6; a second embodiment is shown in FIGS. 7-11; a third embodiment is shown in FIGS. 12-15; a fourth embodiment is shown in FIGS. 16-22; a fifth embodiment is shown in FIGS. 23-25; a sixth embodiment is shown in FIGS. 26-27; a seventh embodiment is shown in FIGS. 28-30; and an eighth embodiment is shown in FIGS. 31-33B. In some cases, the locking device may also include anti-theft features, as described below and shown in FIG. 34-39. The inventive concepts described herein are not limited to the specific examples depicted in the figures and may be applied to any tote bin or container locking device, as will be apparent to those of ordinary skill in the art in view of this disclosure.

As described below, some embodiments of the locking device, including those described in connection with FIGS. 1-25, for example, may include an elongate lock member that is associated with at least one lid of the tote bin and a lock housing that is associated with at least one sidewall of the tote bin and remains with the tote bin even when the lock is disengaged and the lid is opened. In other embodiments, the locking device may be associated only with the lids of the tote bin. The elongate lock member, in some cases, may be a rigid member that includes a locking surface that is stepped or notched. In other cases, the elongate lock member may include a flexible cable with a locking surface formed at an end of the cable. The lock housing may include a lock assembly that is configured to engage the locking surface of the elongate lock member to secure the lid in a closed and locked position. The lock assembly may be unlocked to allow the elongate lock member to be disengaged from the lock housing via a key (e.g., a magnetic key), thereby allowing the lid to be opened. The locking device may further include or be usable with a security element and/or a security module configured to provide alarm functionality, for example, when the tote bin is removed from a specified location and/or when the lock has been compromised.

In some embodiments, described below, a locking device is provided for locking a container having sidewalls and at least one lid defining an open position and a closed position. The locking device may include an elongate lock member configured to engage one of the at least one lid or at least one of the sidewalls and a lock housing associated with the other of the at least one lid or the at least one of the sidewalls. The lock housing may be configured to at least partially receive the elongate lock member. Thus, the lock housing may include a lock assembly defining a locked position, in which the lock assembly is configured to engage the elongate lock member and secure the lid(s) in the closed position. In other words, the lids may be movable between the open position and the closed position; the elongate lock member may be movable between an extracted position (e.g., withdrawn from the lock housing) and a retracted position (e.g., received into the lock housing); and the lock assembly may be movable between the locked position (e.g., engaging or positioned to engage the elongate lock member) and the unlocked position (e.g., positioned away from the elongate lock member).

FIG. 1 depicts an example of a tote bin 10. The tote bin 10 may be sized and shaped in various ways. For example, the tote bin 10 of FIG. 1 includes a body portion 12 and opposed foldable lids 14, 16. The tote bin 10 may be opened by pulling the lid portions away from the body 12 of the tote bin 10. Handles 18 may be formed in the body portion 12 to help a user carry the tote bin 10. The handles 18 may be defined by an integrally-molded concavity or protrusion formed on the body portion 12 sidewalls, as shown, or the handles 18 may be formed separately and attached to the body portion or elsewhere on the tote bin, e.g., via an adhesive or fasteners.

Figure 2:
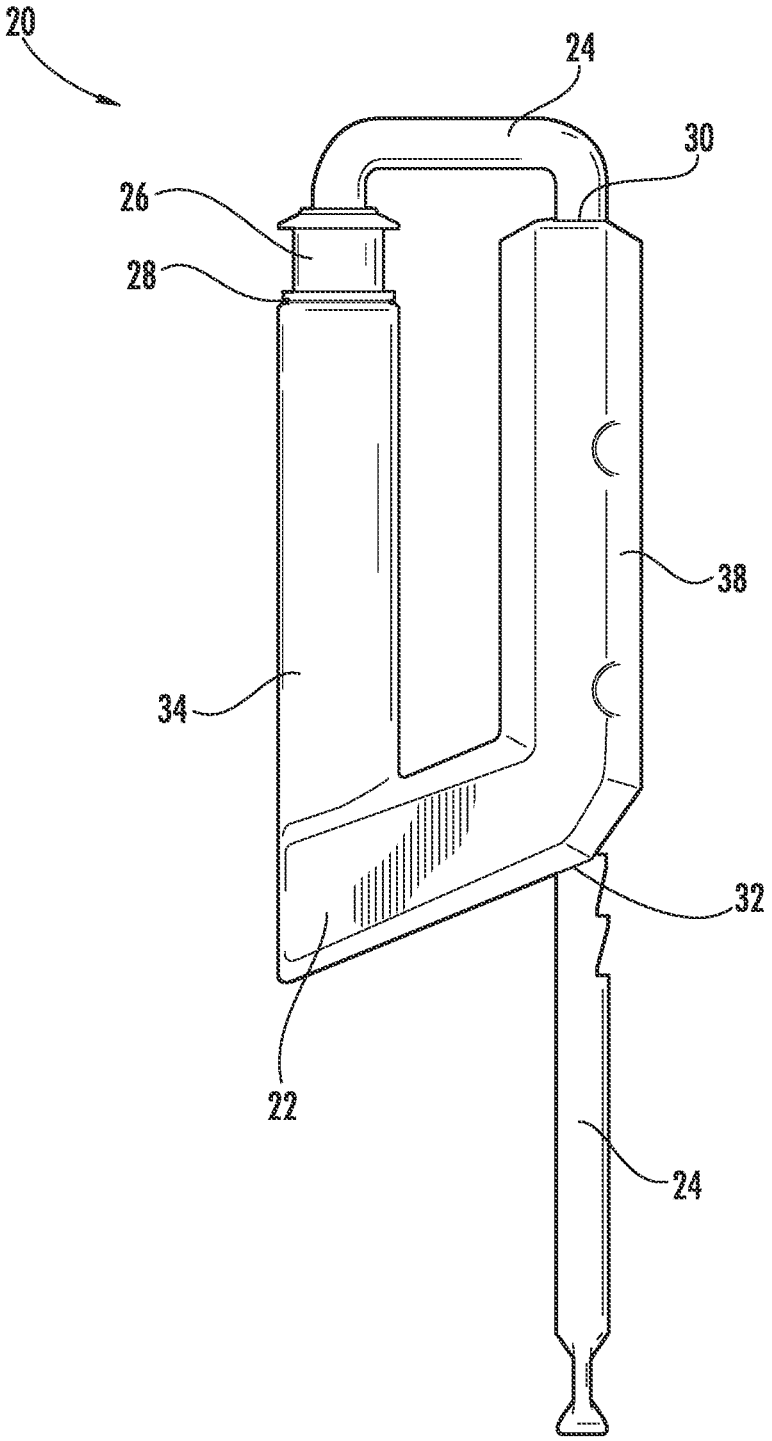
FIG. 2 illustrates a locking device in accordance with one exemplary embodiment of the present invention.

FIG. 2 shows a locking device 20 according to one embodiment. The locking device includes a housing 22, a locking pin 24, and a retaining grommet 26. The housing 22, which is shown in cross-section in FIG. 3, defines a first opening 28, a second opening 30, and a third opening 32 through which portions of the locking pin 24 pass. In this regard, the housing 22 defines an interior portion 34 that resides within a sidewall 36 of the tote bin 10, as shown in FIG. 3, and an exterior portion 38 that is external to the sidewall 36.

The locking pin 24 shown in FIG. 2 represents an exemplary elongate lock member. Other exemplary elongate lock members (e.g., latch pin 102, flexible cable 202, etc.) are shown in connection with the other locking device embodiments discussed below. Accordingly, the present invention is not limited to a specific elongate lock member structure and may be applied to any elongate structure that is associated with a container lid, configured to be received by a lock housing, and further configured to be engaged by a lock assembly.

The interior portion 34 defines a first channel 40 in which a first leg 42 of the U-shaped locking pin 24 is configured to reside via the first opening 28. The second leg 44 of the U-shaped locking pin 24 may be configured to pass through a second channel 46 defined by the exterior portion 38 of the housing 22 via the second opening 30 and the third opening 32. Referring to FIG. 3, the retaining grommet 26 may be formed of an elastomer or other durable material and may be configured to fit on the first leg 42 of the locking pin 24 and within a hole 48 formed in the lid 16 of the tote bin, thereby holding the locking pin 24 to the lid 16 when the lock 20 is unlocked and the lid 16 is opened. In cases where the tote bin has two lid portions, as pictured in FIG. 1, the lids 14, 16 may be configured to overlap, such that the first lid 16 covers and secures at least a portion of the second lid 14, as shown in FIG. 3. In this case, the retaining grommet 26 may be configured to hold the locking pin 24 to the first lid 16 when the tote bin is unlocked and the lids are opened.

Figure 4:
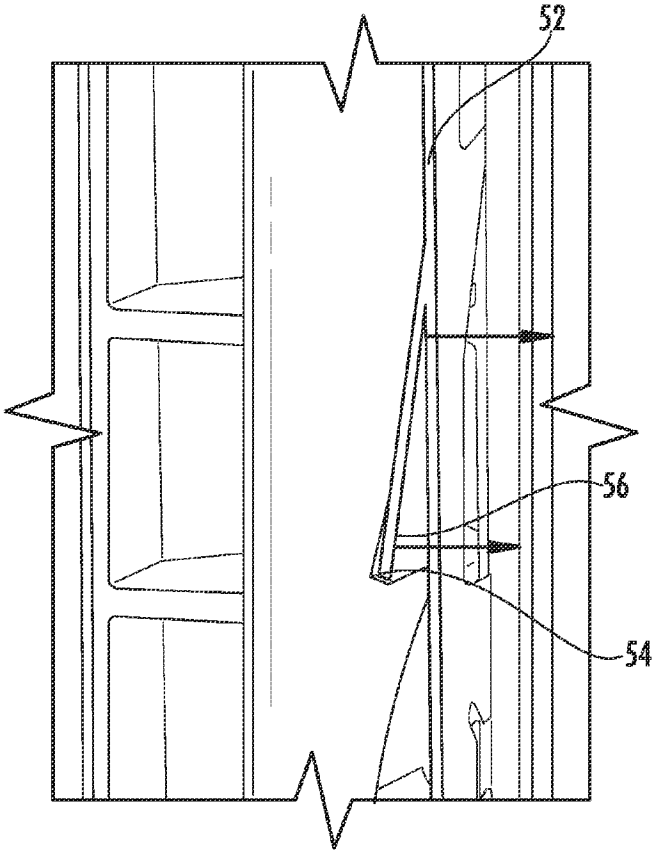
FIG. 4 is a detail view of a locking surface of a locking pin and an engagement surface of a locking spring shown in FIG. 3.
Figure 3:
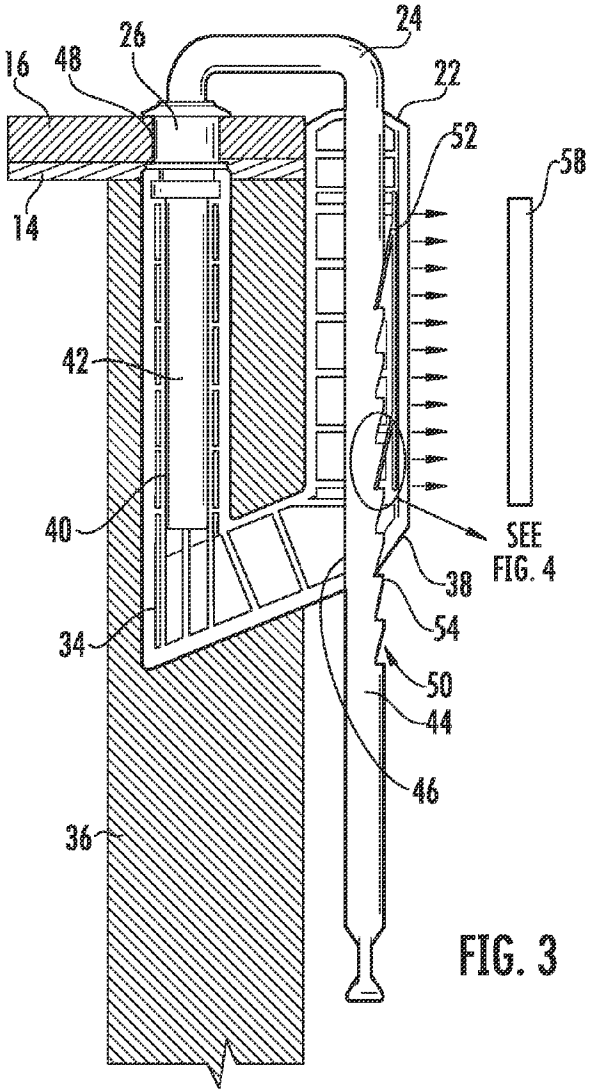
FIG. 3 is a cross-sectional view of the locking device of FIG. 2.

Turning now to FIG. 4, a detail view of the lock assembly or mechanism of the locking device 20 shown in FIG. 3 is provided. The second leg 44 of the locking pin 24 includes a locking surface 50 comprising a series of notches 54 that are configured to engage a locking spring 52 such that the engaging ends 56 of the locking spring 52 are received, in a locked position, into notches 54 and, thus, prevent the second leg 44 from being retracted from the second opening 30 of the housing. Thus, when the locking spring 52 is engaged with the locking surface 50 of the locking pin 24, the lock 20 is in the locked position and the lids 14, 16 are secured to the sidewall 36 of the tote bin. It is noted that the sidewall 36 may define a rim or ledge, to which the lids 14, 16 are secured when the locking device is in the locked position. The term "sidewall" is used in this disclosure for purposes of explanation and is understood to include the sidewall, any rim, ridge, flange, overhanging portion, or other feature that is defined by or affixed to the sidewall and may be used to anchor the lid(s) in a locked position.

Figure 5A:
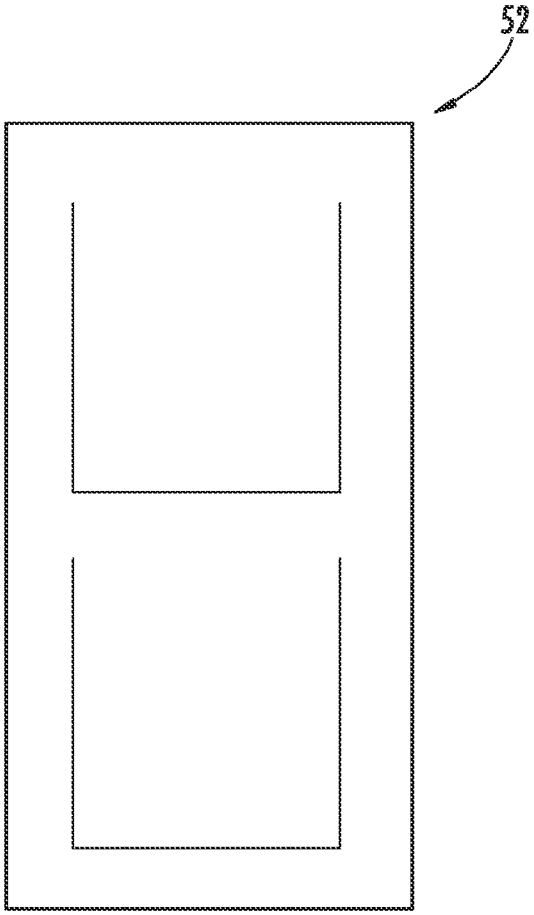
FIG. 5A illustrates a front view of a locking spring in accordance with one exemplary embodiment of the present invention.
Figure 5B:
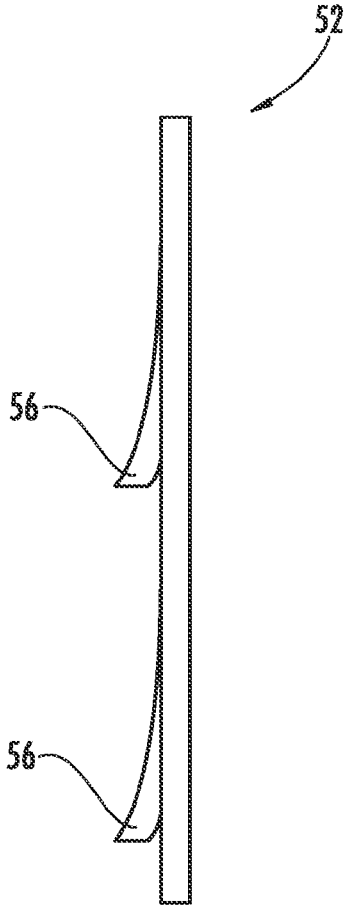
FIG. 5B illustrates a side view of the locking spring of FIG. 5A.
Figure 6C:
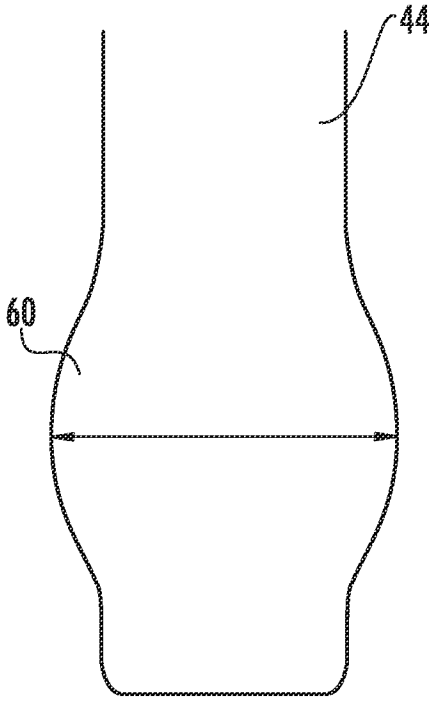
FIG. 6C illustrates a front view of the end of the locking pin of FIG. 6A.
Figure 6B:
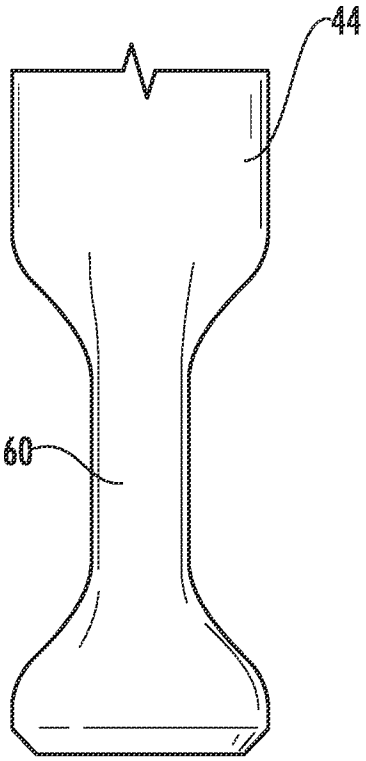
FIG. 6B illustrates a side view of the end of the locking pin of FIG. 6A.
Figure 6A:
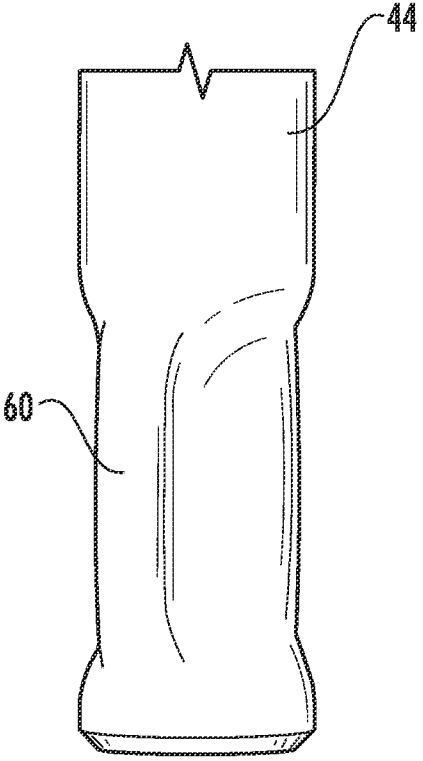
FIG. 6A illustrates a perspective view of an end of the locking pin of FIG. 2 in accordance with one exemplary embodiment of the present invention.

The locking spring 52, which is shown separately in FIGS. 5A and 5B, may be made of a material that reacts to an applied magnetic force. In this way, the locking device 20 may be released by applying a magnetic key 58 to the exterior portion 38 of the housing 22, as shown in FIG. 3. The magnetic force (indicated by the series of arrows in FIGS. 3 and 4) serves to overcome the bias of the spring's engaging ends 56 towards the locking surface 50 and, thus, may remove the engaging ends 56 from engagement with the locking surface 50. The locking device is thus "unlocked," and the locking pin 24 may be retracted via the second opening 30 of the housing.

In one embodiment, a portion of the second leg 44 of the locking pin 24 may be smooth (e.g., devoid of notches) such that once the locking surface 50 is clear of the locking spring 52, the magnetic key 58 may be removed from the exterior portion 38 of the housing and the remaining smooth surface of the locking pin 24 may be able to slide past the locking spring 52. In some embodiments, the smooth portion of the second leg 44 of the locking pin 24 may form a bulge 60 at its end, as pictured from three angles in FIGS. 6A, 6B, and 6C. The second channel 46 formed in the exterior portion 38 of the housing may be configured such that the maximum width of the bulge 60 (illustrated in FIG. 6C) is only able to pass through the channel in a certain orientation. In this way, rotation of the locking pin 24 within the housing 22 may be reduced. Furthermore, the second opening 30 may be configured to have a smaller diameter than the width of the bulge 60, thereby preventing the separation of the second leg 44 of the locking pin 24 from the assembly.

Figure 7:
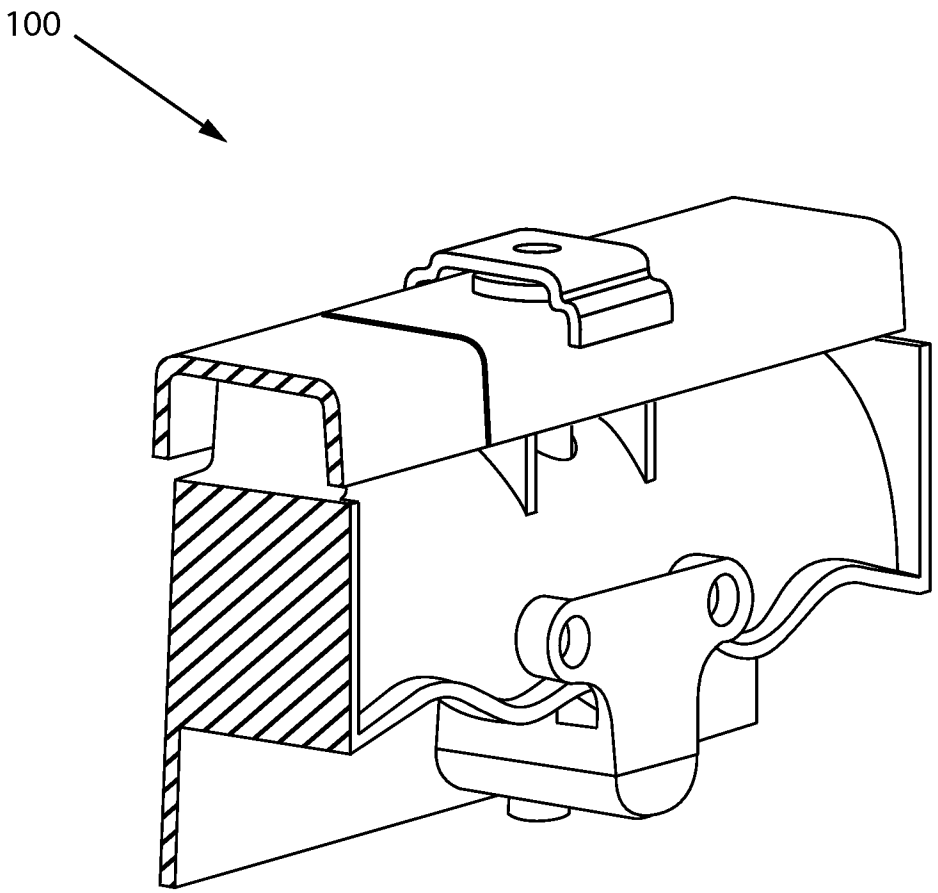
FIG. 7 illustrates a locking device structured in accordance with another exemplary embodiment of the present invention.
Figure 8:
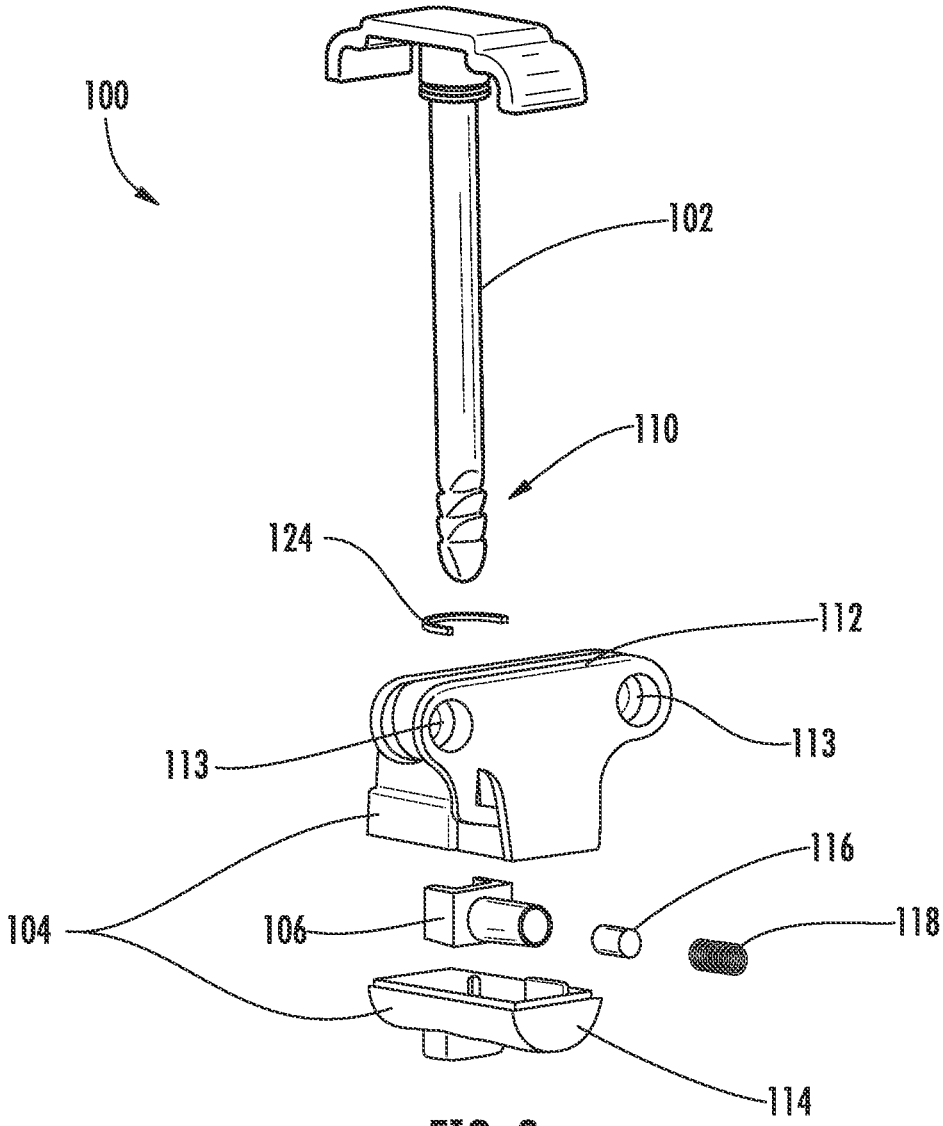
FIG. 8 illustrates an exploded view of the locking device of FIG. 7.
Figure 10A:
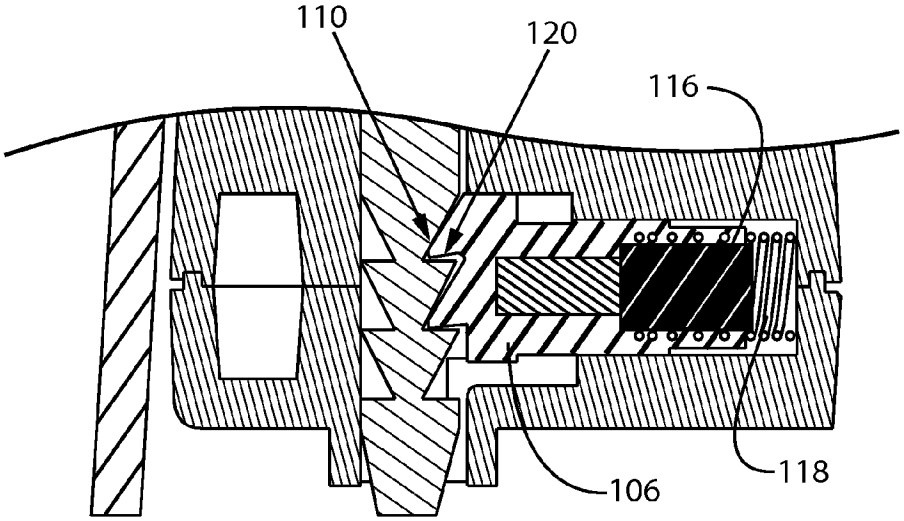
FIG. 10A is a cross-sectional detail view of the locking device of FIG. 7 with the locking slider assembly in a locked position.
Figure 10B:
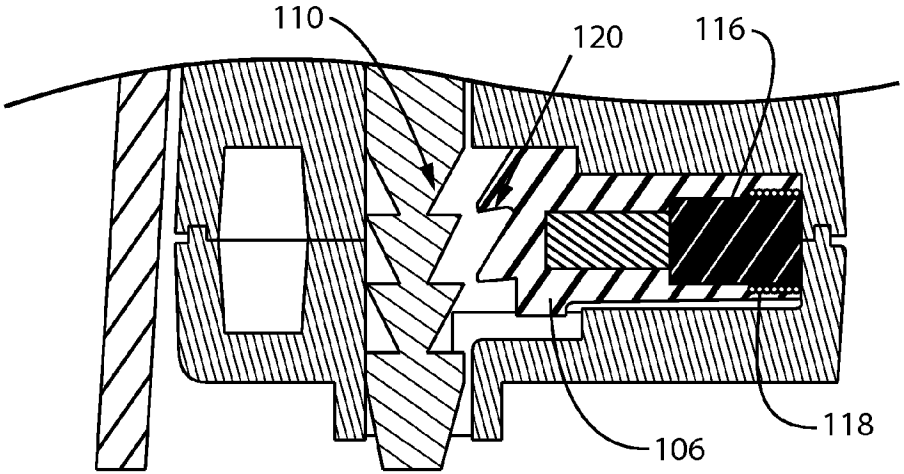
FIG. 10B is a cross-sectional detail view of the locking device of FIG. 7 with the locking slider in an unlocked position.
Figure 9:
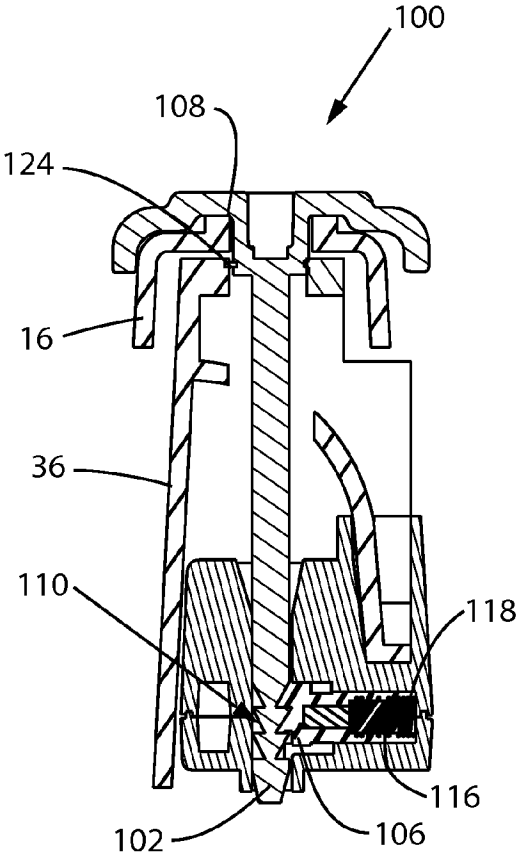
FIG. 9 is a cross-sectional view of the locking device of FIG. 7.

In other embodiments, a locking device 100 is provided as shown in FIGS. 7 and 8. With reference to FIG. 8, the lock 100 includes a latch pin 102, a housing 104, and a locking slider 106. The latch pin 102 is configured to pass through holes 108 defined in the lids 14, 16 and sidewall 36 of the tote bin 10 (shown in FIG. 9) such that a locking surface 110 of the latch pin 102 may engage the locking slider 106 when the tote bin is locked. The housing 104 may comprise a top portion 112 and a bottom portion 114 that are configured to fit together and surround the locking slider 106. In this regard, the top and bottom portions form a space in which the locking slider 106 is configured to move into and out of engagement with the locking surface 110 of the latch pin 102, as shown in FIGS. 9, 10A, and 10B. The housing 104 may be attached to the sidewall 36 via fasteners, such as rivets, that pass through holes 113 formed in the housing 104 and sidewall 36. In other embodiments, at least one of the sidewalls at least partially forms the lock housing 104 (e.g., the housing may be integrally formed with a sidewall of the tote bin), as will be apparent to one of ordinary skill in the art in view of this disclosure.

The locking slider 106 may include a magnetic element (e.g., a steel pin 116) that is movable between a locked position and an unlocked position and a compression spring 118 that is configured to surround the steel pin 116 and bias the locking slider 106 towards the locked position, in which the engagement surface of the locking slider 106 may engage the locking surface 110 of the latch pin 102, as shown in FIG. 9. Thus, when the lock 100 is in a locked configuration, as depicted in FIG. 10A, an engagement surface 120 of the locking slider 106 is pushed into engagement with the locking surface 110 of the latch pin 102. For example, the locking surface 110 may include notches that are configured to engage corresponding notches on the engagement surface 120 of the locking slider 106.

Figure 11:
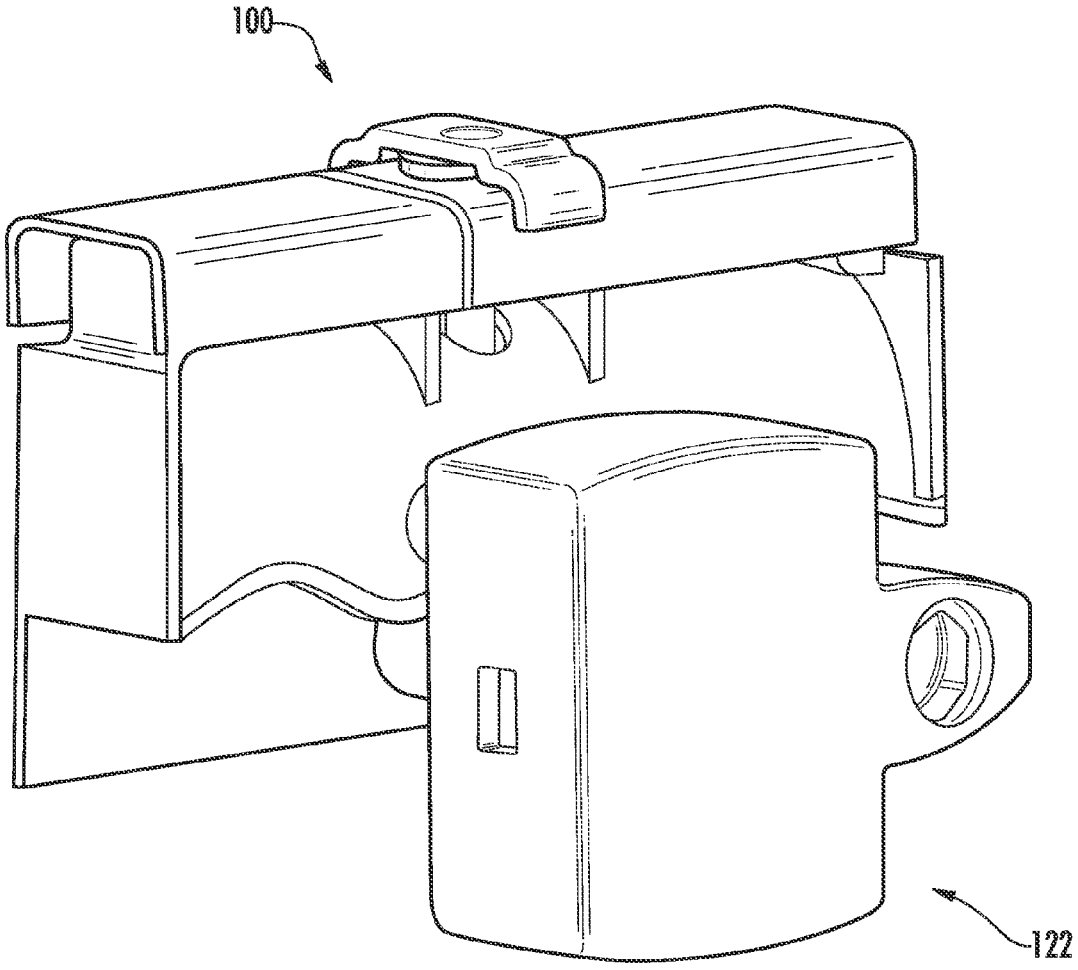
FIG. 11 illustrates a magnetic key in accordance with one exemplary embodiment of the present invention.

Referring again to FIG. 8, the steel pin 116 may be configured to fit within the locking slider 106 in such a way that the locking slider 106 moves with the steel pin 116. For example, the locking slider 106 may form an interference fit with the steel pin 116, or the steel pin 116 may be otherwise fixed to the locking slider 106. Although a steel pin 116 is described above, it is understood that the magnetic element may be made of other magnetic materials. Thus, the magnetic element may be driven from the locked position to the unlocked position against the spring bias by positioning a magnetic key in magnetic proximity to the magnetic element. For example, as shown in FIG. 11, the application of a magnetic key 122 to the exterior portion of the housing 104 may serve to attract the steel pin 116 away from the latch pin 102 and may thus move the locking slider 106 out of engagement with the locking surface 110 of the latch pin 102 (i.e., by compressing the spring 118) as illustrated in FIG. 10B. Therefore, when the magnetic key 122 is applied, the latch pin 102 may be removed from the hole 108 defined in the lids 14, 16 and sidewall 36 of the tote bin.

In some embodiments, a frictional element, such as a C-clip 124, is provided (shown in FIGS. 8 and 9) for maintaining the latch pin 102 with the first lid 16. For example, the C-clip 124 may be configured to fit onto the latch pin 102 and to provide an interference fit with the hole 108 formed in the first lid 16. In this way, the latch pin 102 may only be disengaged from the locking slider 106 and retracted from the housing 104 by opening the respective lid, as the latch pin is not movable separately from the lid.

An alternative embodiment to that illustrated in FIG. 8 is illustrated in FIGS. 12-15. The locking device 200 of the illustrated embodiment features a flexible cable 202, a housing 204, and a locking slider 206. The flexible cable 202 may be made of a multi-strand steel cable with or without a vinyl coating 203; however, other materials of sufficient strength and flexibility may also be used. The flexible cable also includes a locking surface 210 that may comprise ferrules or similar features that can be grasped by the lock assembly described below.

The flexible cable 202 is configured to pass through holes 208 defined in the lids 14, 16 and sidewall 36 of the tote bin 10 (shown in FIG. 14) such that the locking surface 210 of the flexible cable 202 is positioned for engagement by the locking slider 206 when the locking slider is in the locked position and the respective lids are closed. The flexible cable 202 may include a cable retaining element 205 that is configured to seat itself on the surface of the first lid 16 and maintain the flexible cable with the respective lid. Thus, as with the embodiment described above in connection with the latch pin of FIGS. 7-11, the flexible cable 202 is extracted from the lock assembly by opening the lid 16, as the flexible cable in this embodiment is not movable separately from the lid. As a result, a retraction force R (shown in FIG. 18) is required to drive the flexible cable from the extracted position to the retracted position, and the flexible cable itself thus defines a drive rigidity for reducing the tendency of the flexible cable to buckle when the retraction force R is being applied (e.g., via movement of the lid).

Figure 12:
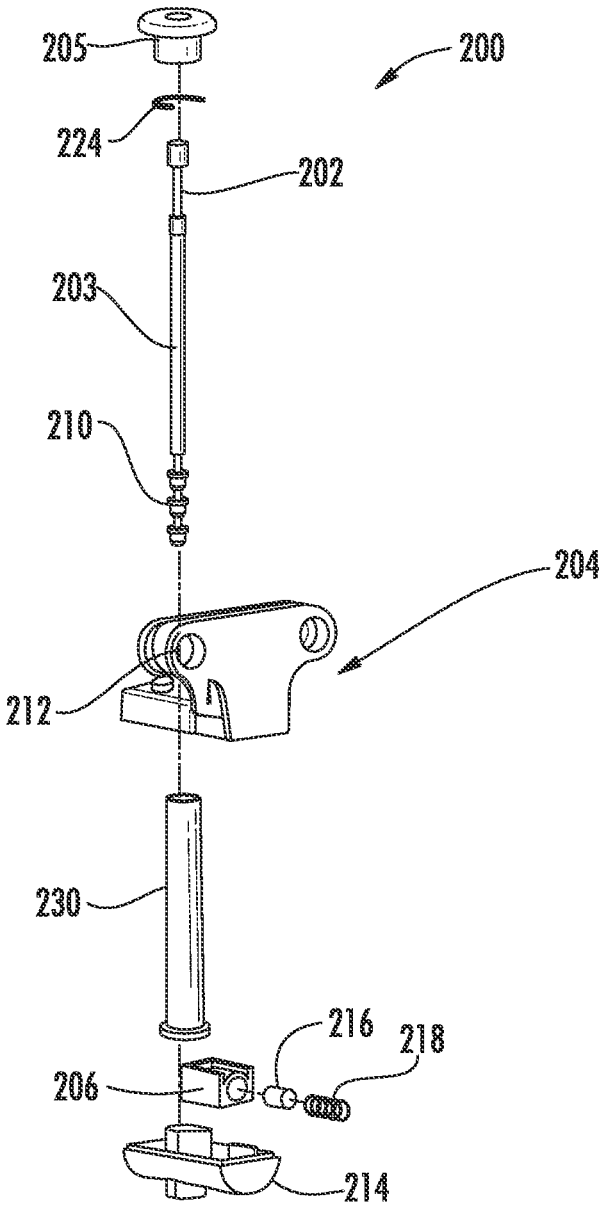
FIG. 12 illustrates an exploded view of the locking device in accordance with another exemplary embodiment.
Figure 14:
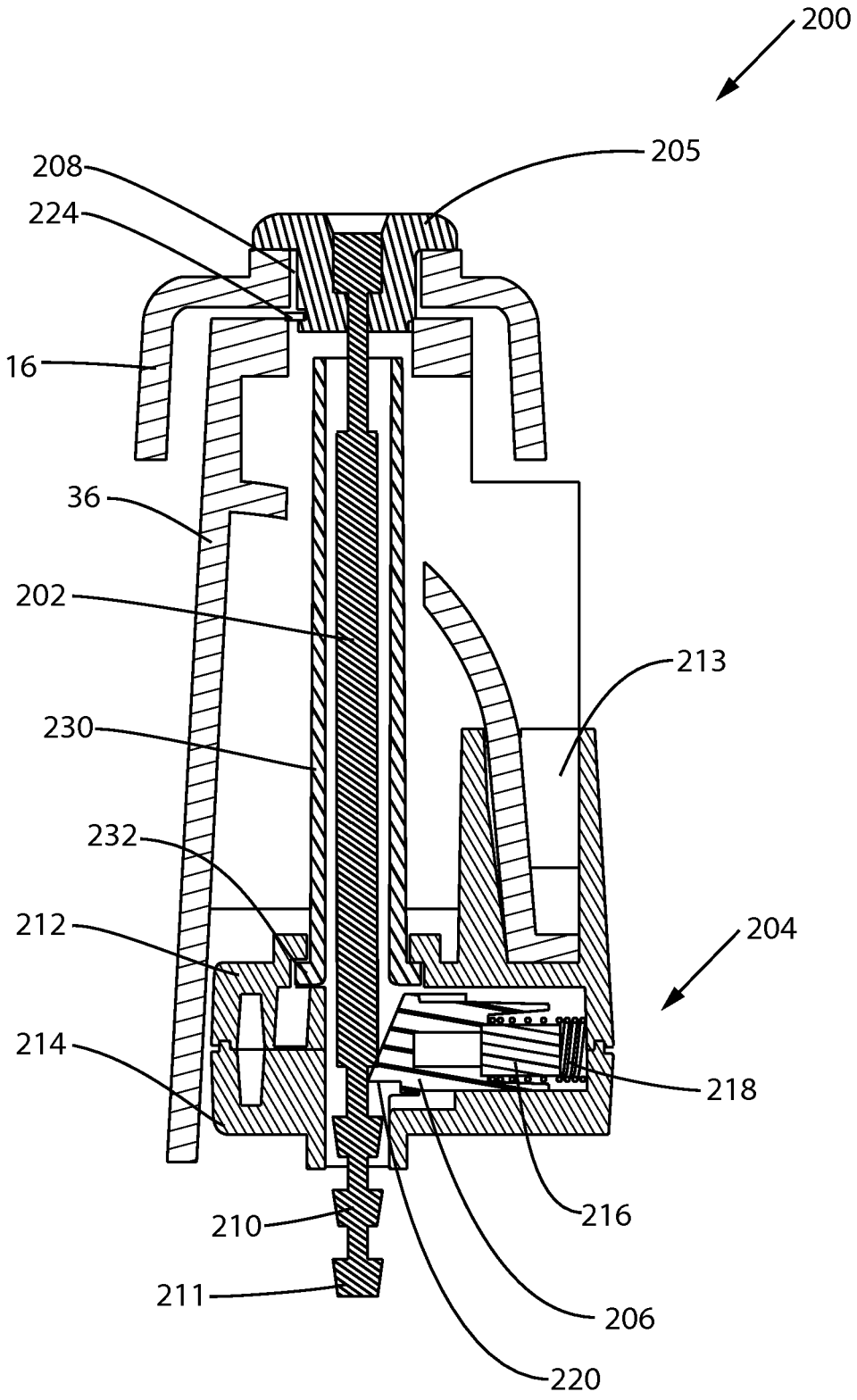
FIG. 14 is a cross-sectional view of the locking device of FIG. 12 with the flexible cable in a retracted position and the locking slider in a locked position.
Figure 15:
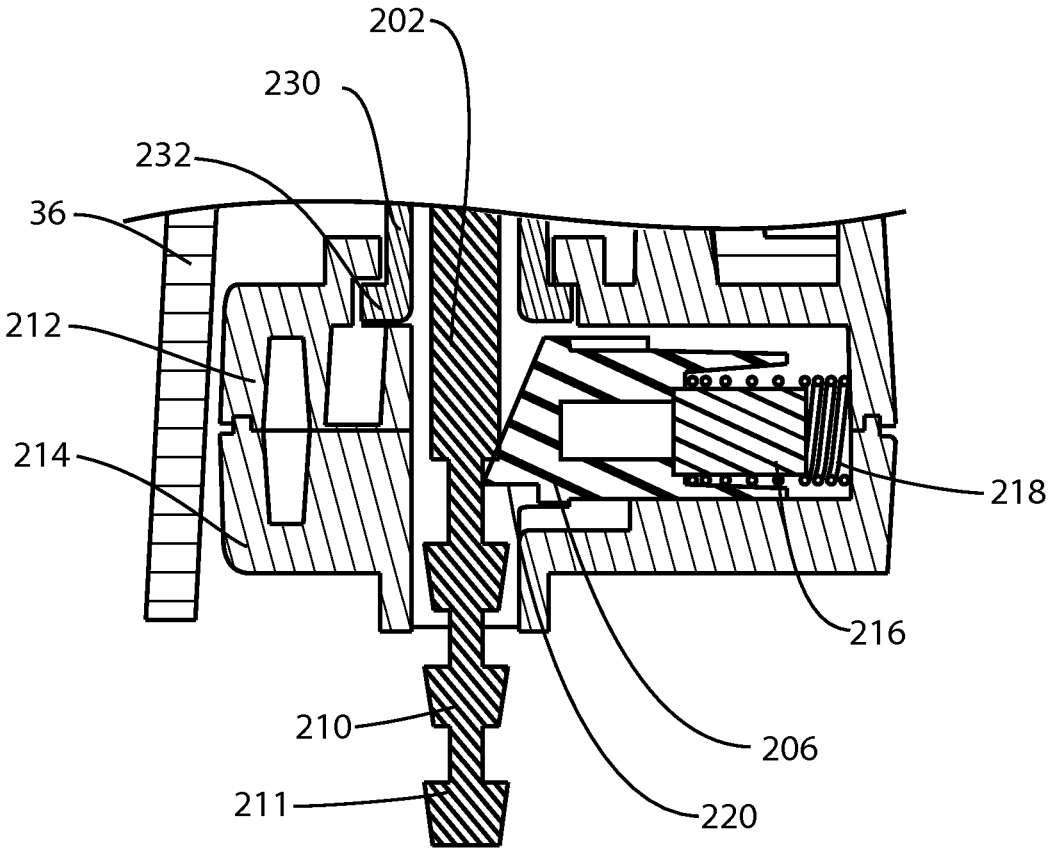
FIG. 15 is a cross-sectional detail view of the locking device of FIG. 14.
Figure 16:
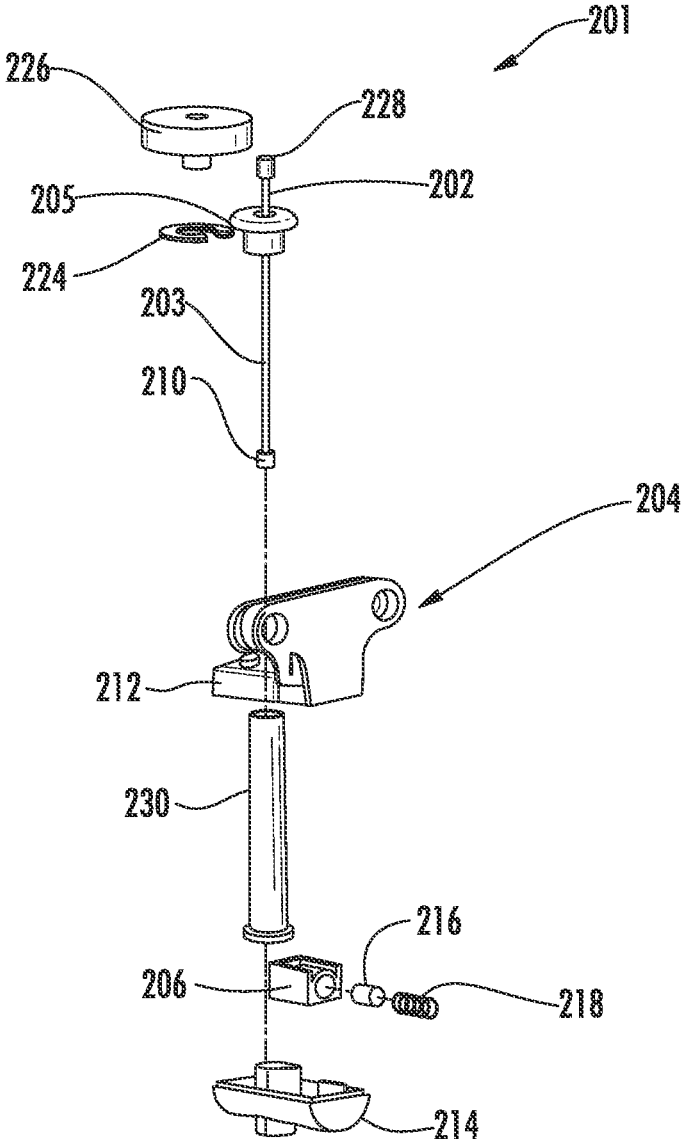
FIG. 16 illustrates an exploded view of the locking device in accordance with another exemplary embodiment.
Figure 17:
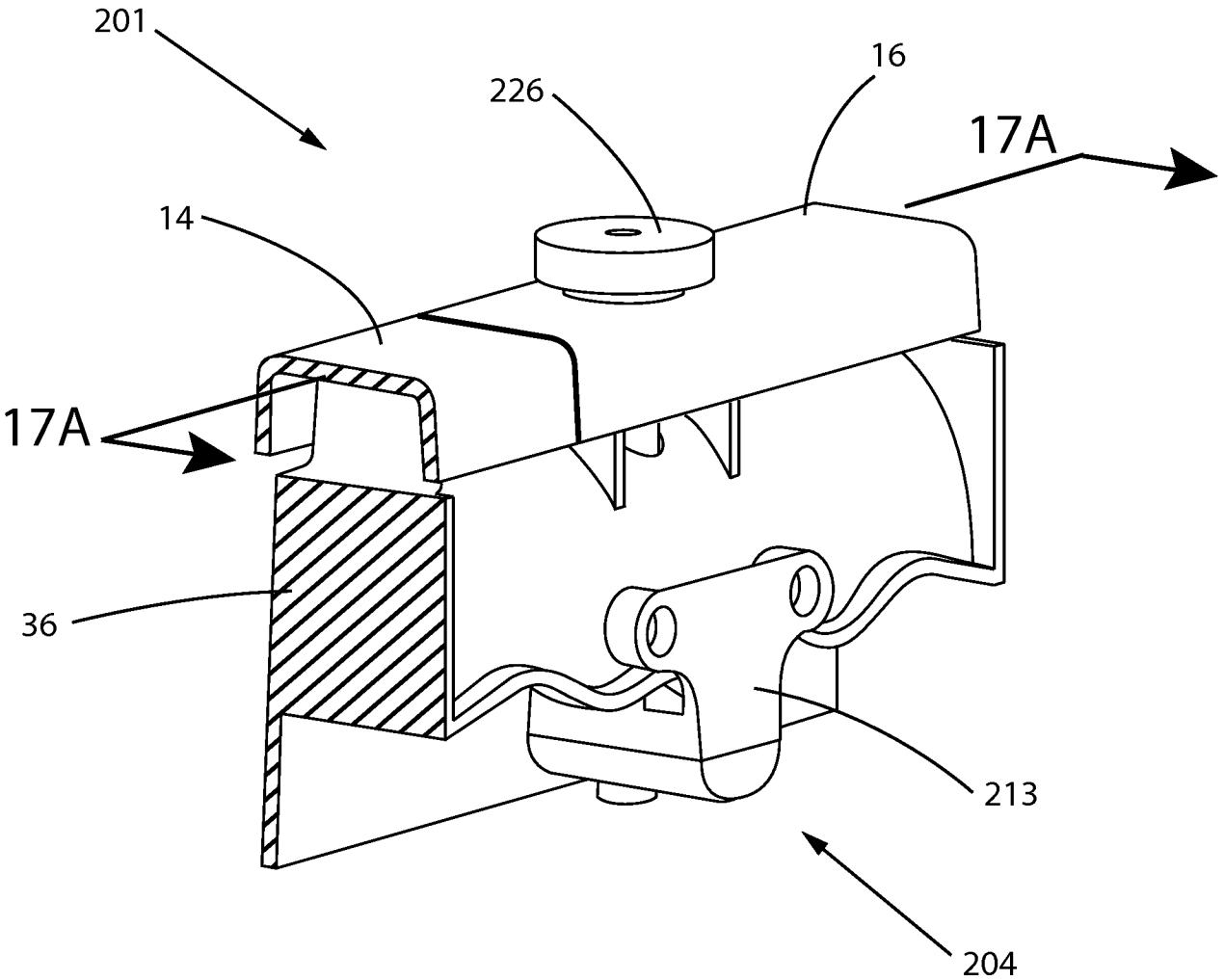
FIG. 17 illustrates a perspective view of the locking device of FIG. 16.
Figure 17A:
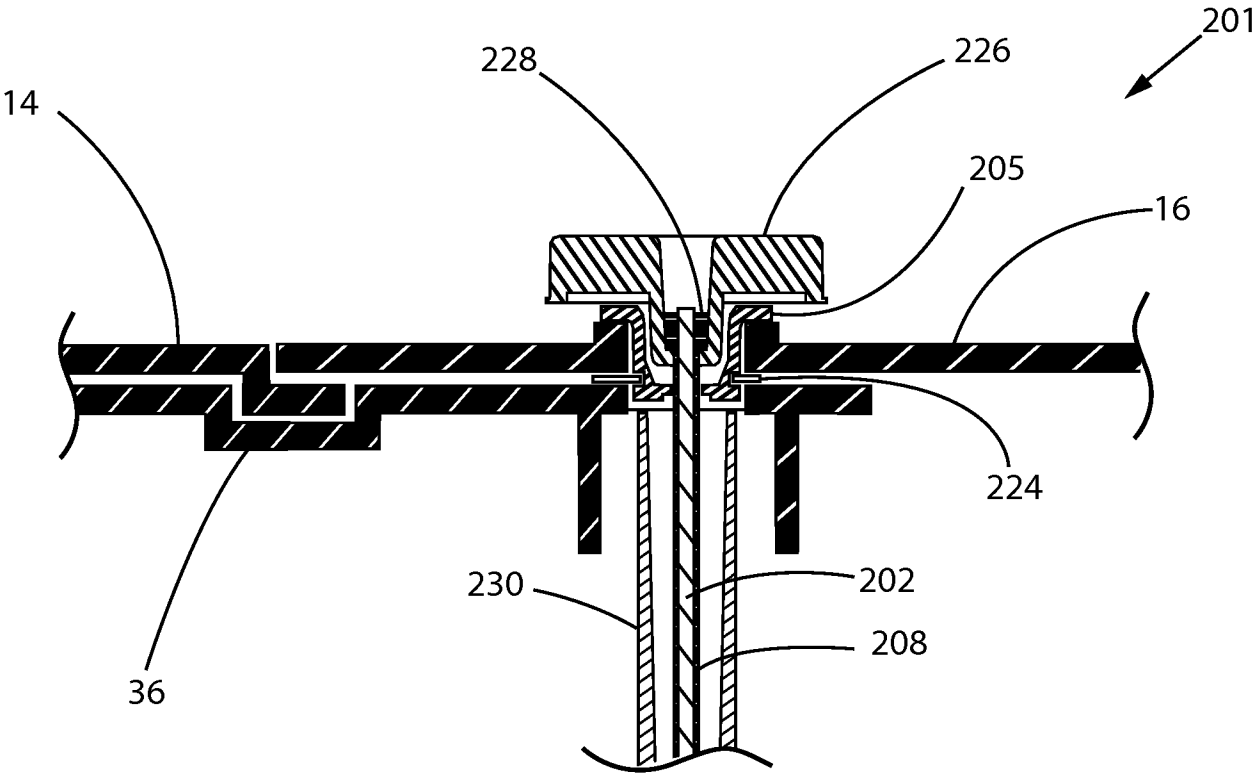
FIG. 17A is a cross-sectional view of the locking device of FIG. 17.

Referring to FIG. 12, the housing 204 may comprise a top portion 212 and a bottom portion 214 that are configured to fit together and surround the locking slider 206. In this regard, the top and bottom portions 212, 214 form a space in which the locking slider 206 is configured to move into and out of engagement with the locking surface 210 of the flexible cable, as shown in FIGS. 14 and 15. The housing 204 may be attached to the sidewall 36 via fasteners, such as rivets, that pass through holes 213 formed in the housing 204 and sidewall 36. In other embodiments, the housing may be integrally formed with the sidewall of the tote bin, as will be apparent to one of ordinary skill in the art in view of this disclosure.

Figure 13:
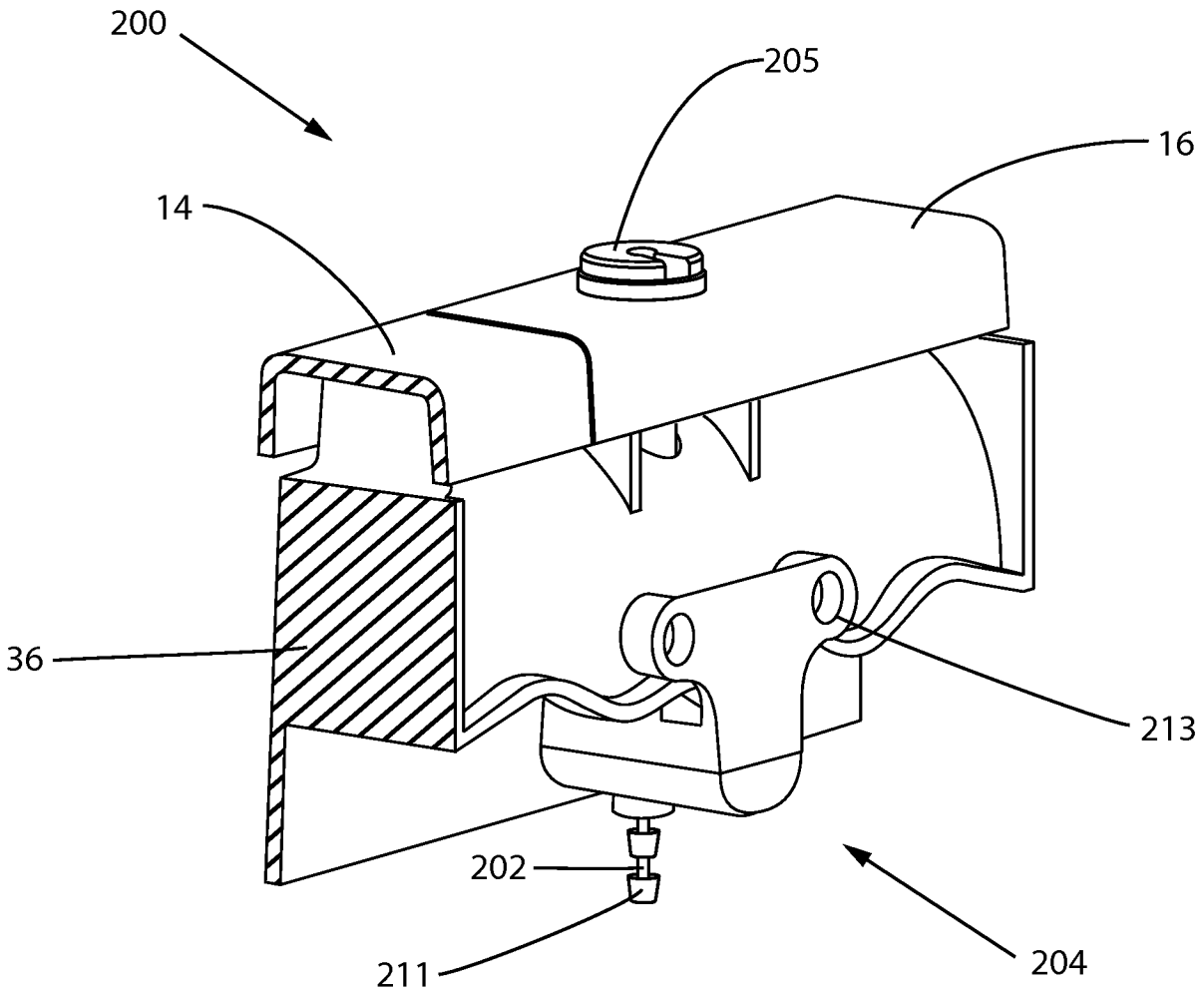
FIG. 13 illustrates a perspective view of the locking device of FIG. 12.

The locking slider 206 may include a magnetic element (such as the steel pin 216 described above) and a compression spring 218 that is configured to surround the steel pin 216 and bias the locking slider 206 towards engagement with the locking surface 210 of the flexible cable 202, as shown in FIGS. 14 and 15. Thus, when the locking device 200 is in a locked position, as depicted in FIG. 13, an engagement surface 220 of the locking slider 206 is pushed into engagement with the locking surface 210 of the flexible cable 202. In one example, the locking surface 210 may include notches or ferrules 211 that are configured to engage corresponding features in the engagement surface 220 of the locking slider 206.

Referring again to FIGS. 14 and 15, the steel pin 216 may be configured to fit within the locking slider 206 in such a way that the locking slider 206 moves with the steel pin 216. For example, the locking slider 206 may form an interference fit with the steel pin 216, or the steel pin 216 may be otherwise fixed to the locking slider 206. Although a steel pin 216 is described above, it is understood that the pin 216 may be made of other magnetic materials.

In various embodiments, for example in the embodiment shown in FIG. 11, application of a magnetic key 122 to the exterior portion of the housing 204 may serve to attract the steel pin 216 away from the flexible cable 202 and may thus move the locking slider 206 out of engagement with the locking surface 210 of the flexible cable 202 (i.e., by compressing the spring 218). Said differently, the magnetic element (e.g., the steel pin 216) may be driven from the locked position to the unlocked position against the spring bias of the compression spring when the magnetic key is positioned in magnetic proximity to the magnetic element. The flexible cable 202 may then be removed from the hole 208 defined in the lids 14, 16 and sidewall 36 of the tote bin.

In some embodiments as shown in FIG. 14, a guide element, such as a guide tube 230, is fixedly disposed within the at least one sidewall associated with the locking housing. The guide tube 230 at least partially surrounds the flexible cable 202 when the flexible cable is in the retracted position. The guide tube 230 is configured to direct the flexible cable 202 towards the lock housing as the flexible cable is driven from the extracted position to the retracted position and is also configured to protect the flexible cable 202 from a cutting device, for example, to maintain the integrity of the lock in the face of an attempted theft. The end 232 of the guide tube 230 may be captured between the top portion 212 and the bottom portion 214 of the housing 204 to properly locate the guide tube 230 within the side wall 36 of the tote bin and prevent movement of the guide tube 230 as the cable 202 is moved into and out of engagement with the engagement surface 220.

In some embodiments as shown in FIGS. 12 and 14, a frictional element, such as a C-clip 224, is provided for maintaining the flexible cable 202 with the first lid 16. For example, the C-clip 224 may be configured to fit onto the cable retaining element 205 and to provide an interference fit with the hole 208 formed in the first lid 16. In this way, the cable retaining element 205 and one end of the flexible cable 202 may remain fixedly attached to the lid 16, while the other end of the flexible cable 202 including the locking surface 210 may be disengaged from the locking slider 206 and extracted from the housing 204 via opening of the respective lid.

Figure 18:
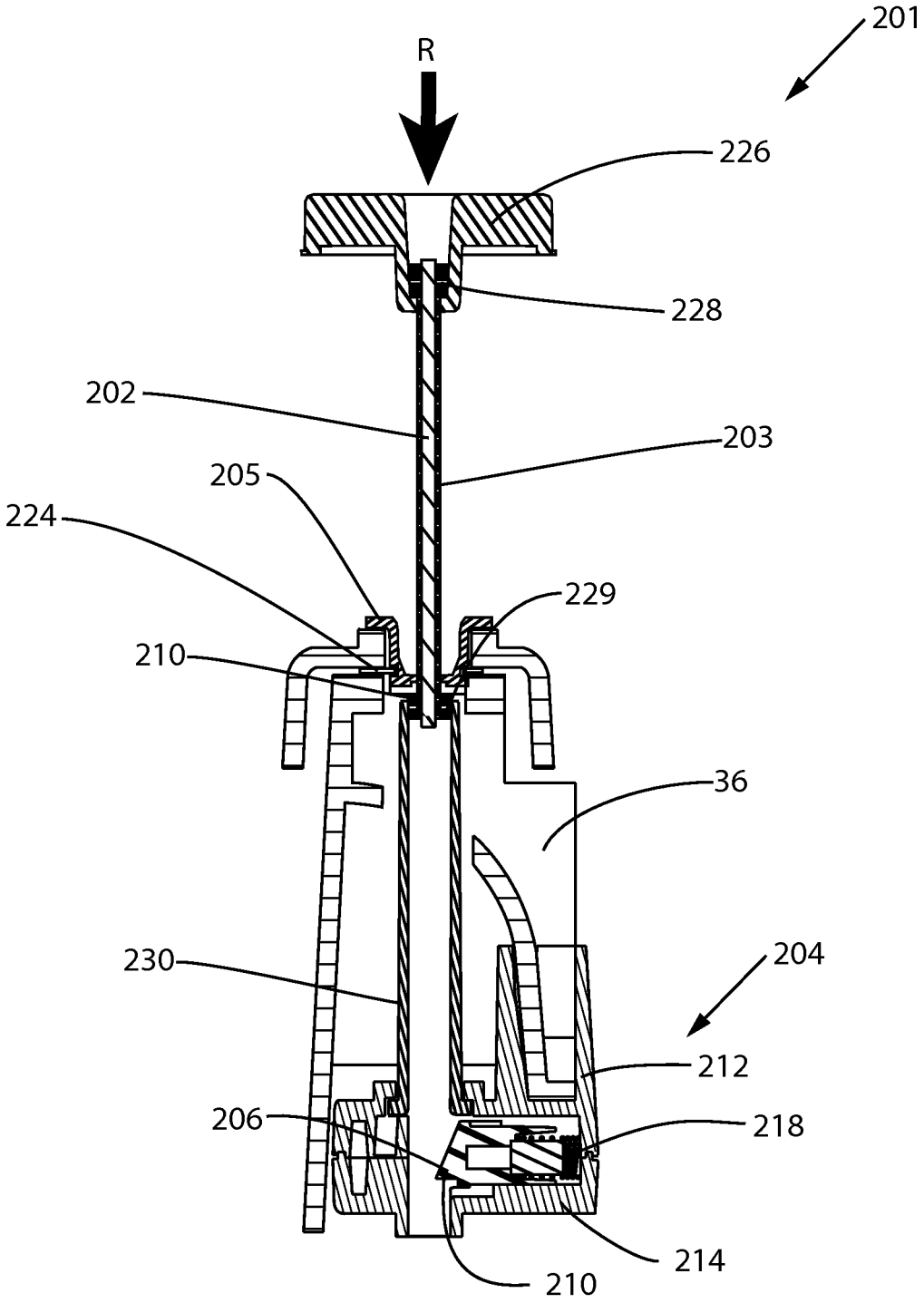
FIG. 18 is a cross-sectional view of the locking device of FIG. 16 with the flexible cable in the extracted position.

In other embodiments, however, a locking device 201 may further include a driving element 226 configured to attach to the top end of the flexible cable 202 (e.g., the end that resides outside the housing 204), as illustrated in FIGS. 16-22. For example, the top end of the cable may include a region of increased diameter, such as a ferrule 228 attached to the top end of the cable 202, which is press fit into the driving element 226, as shown in FIG. 18. In this way, a user may grip the driving element 226 to extract the cable 202 from the lock housing 204 and unlock the tote. Thus, in such embodiments, the flexible cable 202 is movable with respect to the lid 16, in addition to being movable with respect to the lock housing 204.

In embodiments including the driving element 226, the cable retaining element 205 may be configured such that the diameter of the opening through which the cable 202 passes is sized to frictionally resist the unintended retraction of the flexible cable 202 back into the housing 204. In this way, the cable 202 may be biased in the extracted position and may require a retraction force R (shown in FIG. 18) to retract the cable into the housing 204. In addition or alternatively, the cable retaining element 205 may include a spring or other component to bias the cable 202 towards the extracted position when the cable is disengaged from the engagement surface 220. In this way, the locking surface 210 may be pulled clear of the engagement surface 220 by the force of the spring or other biasing component upon the unlocking of the device.

Thus, a user may extract the cable 202 from the lock housing 204 upon unlocking the locking device (e.g., with the magnetic key 122 of FIG. 11) by applying the retraction force R (i.e., pulling on the driving element 226) and may subsequently cease applying the retraction force without being concerned that the cable 202 will inadvertently retract into the housing 204 and re-engage the locking slider 206, thereby locking the tote as described above. For example, in the case of a tote bin having two locks on opposite sides of the tote bin, the user may be able to unlock one side and then may proceed to open the other side or otherwise release his grip of the driving element 226 with the aid of the cable bias.

Alternatively or in addition to the friction fit of the cable 202 with the cable retaining element 205, the first lid 16 itself may be configured with a capture track, clip 240 (shown in FIG. 21), and/or other cable securing feature that the user may engage to hold the cable 202 in the extracted position. For example, the clip 240 may be configured to receive at least a portion of the length of the cable 202 such that the cable 202 is held against the surface of the lid 16 in an extracted position to allow the user to unlock the other side of the tote bin without manually retaining the cable 202 in the extracted position. The clip 240 may be configured to receive the diameter of the cable 202 once the cable has been extracted from the lock housing 204, or the clip may be configured to engage the driving element 226 to keep the cable from retracting into the housing 204. In other embodiments, a capture track may be provided that engages one or more of the driving element 226, the cable 202, and/or the cable retaining element 205 in a way that allows the unlocked assembly (driving element, cable, and/or cable retaining element) to "ride" up and down the lid to and from the retracted position. Numerous other features may be used to hold the cable 202 in the extracted position, such as a channel formed in the lid 16 for frictionally receiving the length of the extracted cable, a clasp that can be moved into engagement with the driving element 226, etc.

In some embodiments, the cable 202 may be configured to define a drive rigidity for reducing buckling of the flexible cable when a retraction force is applied. As will be apparent to one of skill in the art in view of this disclosure, the cable 202 may be flexible enough to bend when such bending is desired (e.g., bending the cable out of the way to facilitate stacking of multiple totes, bending to engage a cable securing feature, etc.) while also possessing sufficient stiffness to allow a user when grasping the driving element 226 to drive the cable 202 back into a retracted position without substantial buckling. Selected values for flexibility and stiffness may vary depending on the application; however, in one embodiment, a 1.59 mm diameter 1×19 preformed galvanized steel cable sheathed with a clear vinyl coating to a 2.381 mm diameter was found to provide desired stiffness and flexibility. Sheathing 203 provided in such embodiments may impart a degree of added stiffness and reduce wear on the cable that may otherwise occur as a result of repeated withdrawals of the cable 202 from the guide tube 230 and cable retaining element 205. Furthermore, the sheathing 203 may be configured to provide a desired degree of friction to the surface of the cable 202, such that the cable has a tendency to remain in the extracted position once the tote bin is unlocked, as previously described.

Figure 19:
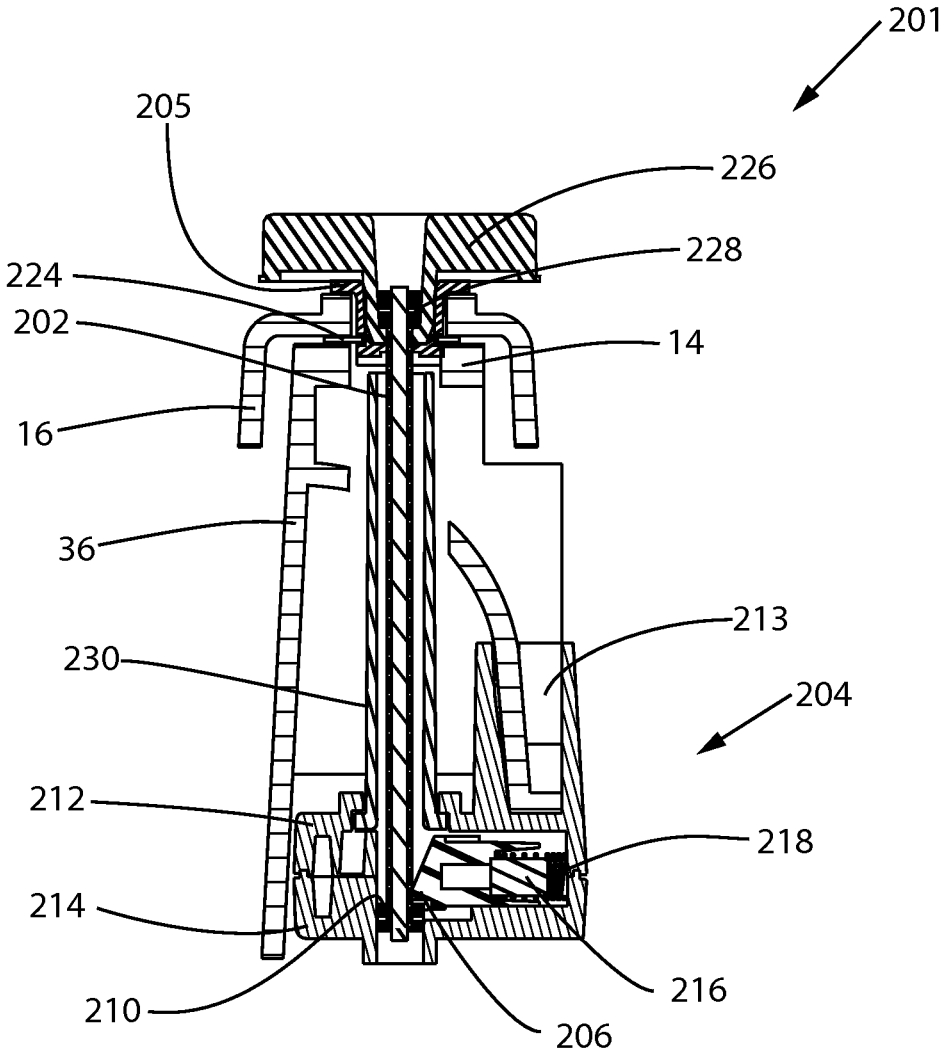
FIG. 19 is a cross-sectional view of the locking device of FIG. 16 with the flexible cable in the retracted position.

Referring again to FIG. 18, starting from the unlocked position, a user may thus be able to push the driving element 226 towards the cable retaining element 205 (for example, after releasing the cable 202 or driving element 226 from the securing feature) without substantial buckling of the cable 202. The cable 202 is simply pushed back through the guide tube 230 until the locking surface 210 is positioned for engagement by the locking slider 206 as shown in FIG. 19. Alternatively, in cases where the elongated lock member is rigid, a movable joint, such as a hinge or ball joint, may be provided to allow the elongate lock member (e.g., the locking pin 24 or latch pin 102) to be moved from a position generally perpendicular to the surface of the first lid 16 to a position generally parallel to the lid 16 when unlocked for securing the elongated member and opening the tote.

Figure 20:
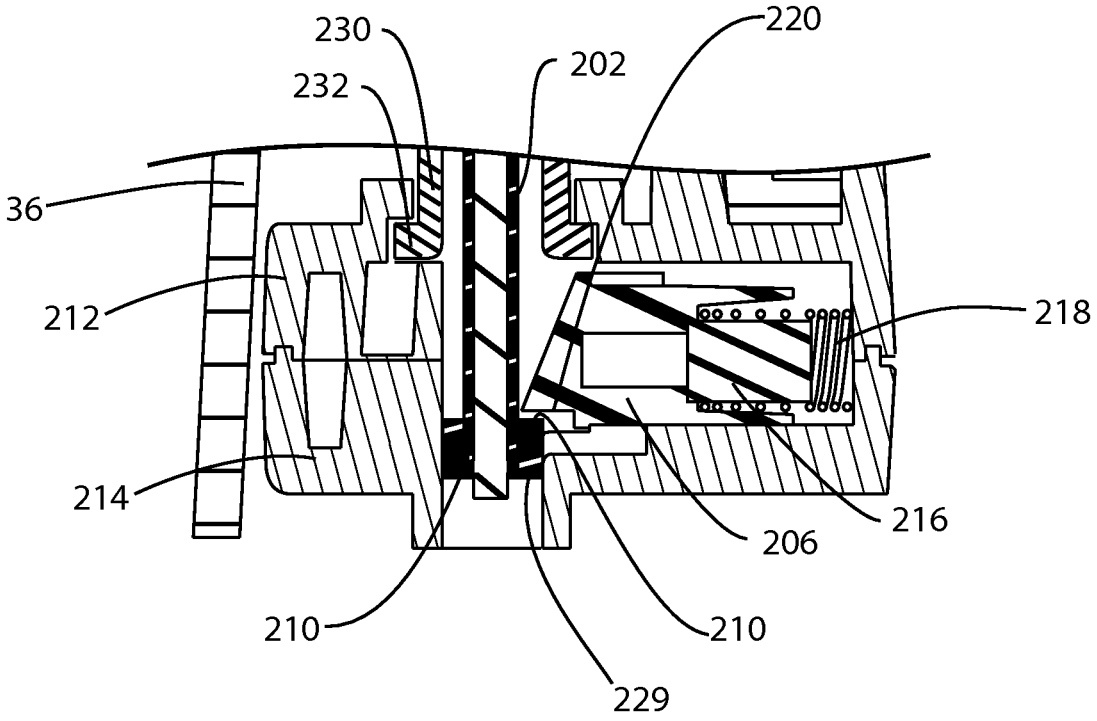
FIG. 20 is a cross-sectional detail view of the locking device of FIG. 19.
Figure 21:
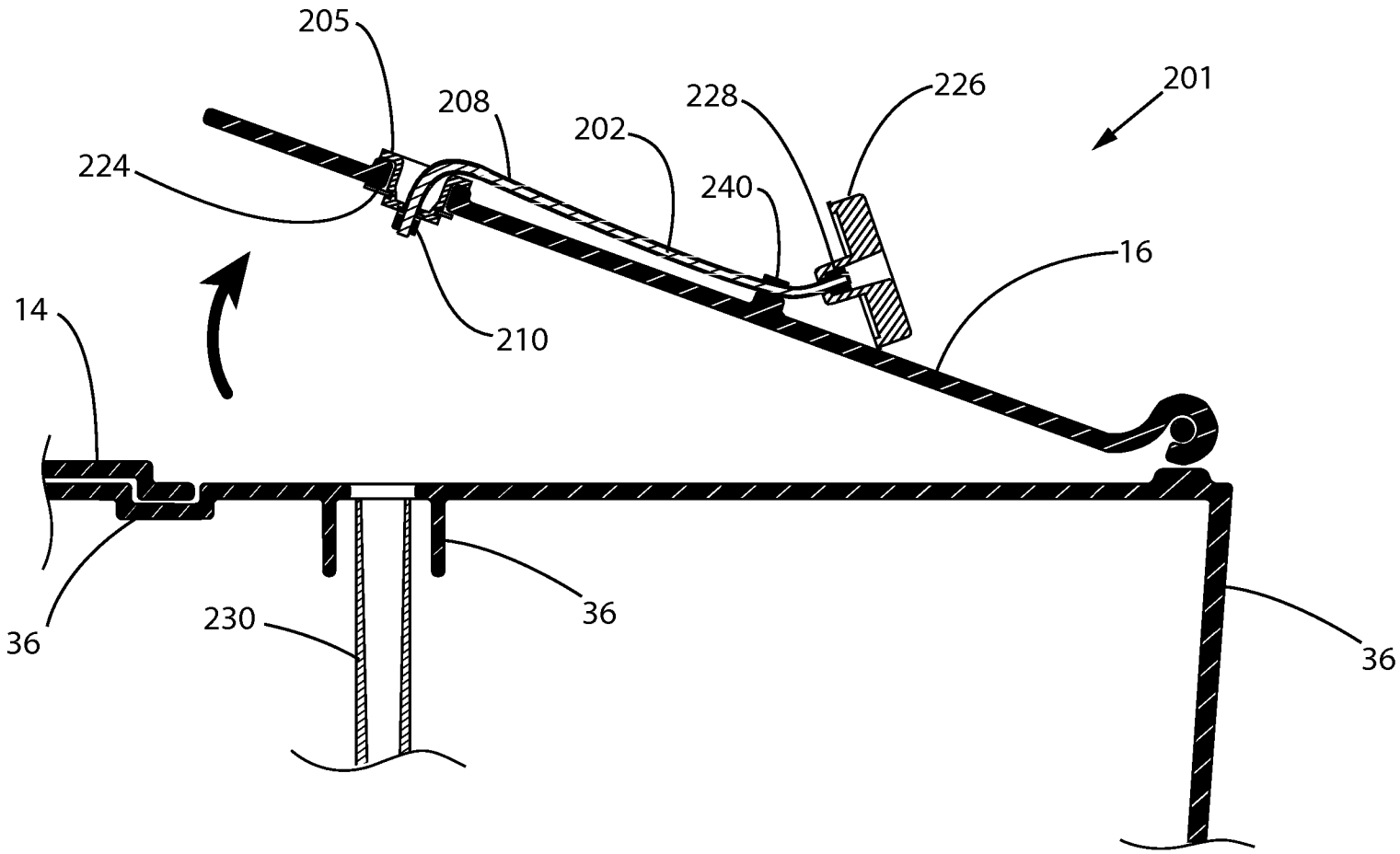
FIG. 21 is a cross-sectional view of the tote bin with the flexible cable in the extracted position in accordance with an exemplary embodiment.
Figure 22:
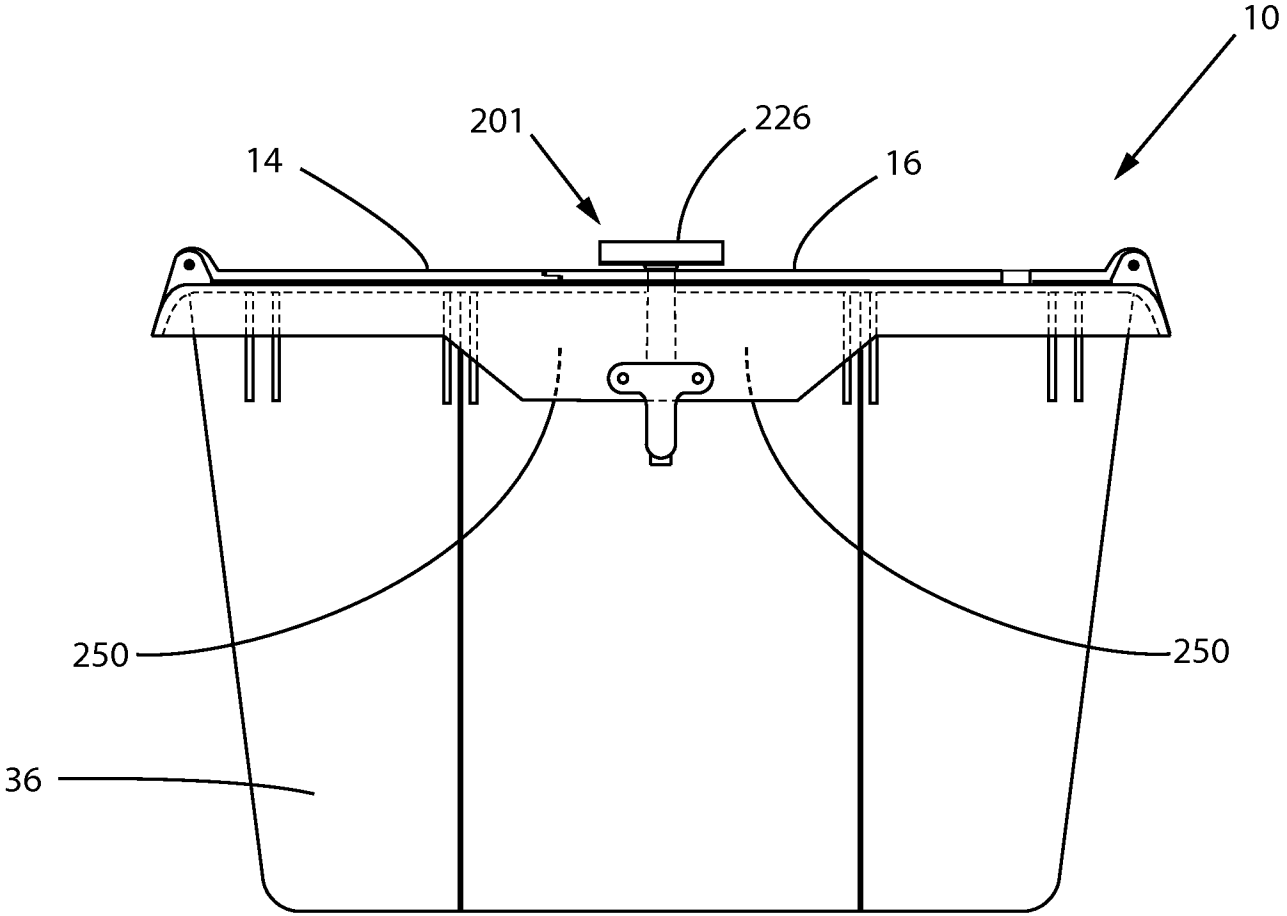
FIG. 22 illustrates a side view of the tote bin in accordance with an exemplary embodiment showing finger pockets.

In some embodiments, the locking surface 210 may differ from that shown, for example, in FIG. 14. For example, as shown in FIGS. 18-20, the locking surface 210 may define a region of increased diameter, such as a second ferrule 229 proximate the bottom end of the cable 202. Thus, as the driving element 226 is pushed towards engagement with the cable retaining element 205, the second ferrule 229 may engage the angled surface of the locking slider 206 and cause the slider to move away from the cable 202, against the force of the spring 218. Once the second ferrule 229 has cleared the locking slider 206 (as shown in FIGS. 19 and 20), however, a top ledge of the ferrule 229 may be securely captured by the engagement surface 220 of the locking slider 206, thereby locking the tote bin. The tote bin may be unlocked using a magnetic key (such as the key 122 of FIG. 11) to draw the locking slider 106 out of engagement with the engagement surface 220, as described above.

Locking devices structured in accordance with various embodiments may be integrally molded into tote bins at manufacture or may be offered as retrofit, detachable locking devices that are fastened to a conventional tote bin at some point after its manufacture. In each embodiment, it is important that the locking device be structured and positioned to limit any detrimental effects that the structure of the locking device may have on the primary function of the tote bins, i.e., to provide an enclosure and a transport for stored items. For example, in one embodiment, it may be desirable to position the structure of the locking device outside of the tote bin (to avoid decreasing tote bin carrying volume) perhaps proximate the tote bin handles. In such embodiments, the locking device may be integrally formed with or attached to the handles of the tote bin such that finger pockets remain defined by the handle (i.e., within a handle cavity) as illustrated, for example, by the retrofit locking device of FIG. 22.

The depicted locking device 201 may be attached to an edge of the tote bin 10 such that a finger pocket 250 is provided on either side of the locking device. The finger pockets 250 may be configured to receive a user's fingers to facilitate the lifting and carrying (i.e., transport) of the tote bin. In this regard, a cavity may extend the length of one or more edges of the tote bin and may, for example, be formed during the molding of the sidewall 36 of the tote bin. Installation of a locking device 201 along the edge of such a tote bin may thus convert the single cavity into two finger pockets 250, allowing the user to grasp the tote bin via one or both of the pockets 250.

Turning to FIG. 23, in some cases, the locking device may be an integral locking device 400 that is integral to the tote bin 10, such as, for example, comprising a housing 404 that is at least partially molded into the sidewall 36 of the tote bin. In this case, the handle 18 may define a window opening 401 configured to allow a user to apply a magnetic key 122 (shown in FIG. 11) to the exterior portion of the housing 404 to unlock the device. Otherwise, without such access, the user may not be able to position the key 122 in magnetic proximity to the locking device 400. Furthermore, the integral locking device 400 may be positioned off-center with respect to the top edge of the sidewall 36 (shown in FIG. 24), rather than centered as shown in FIG. 23, for example, so as to allow a larger volume cavity for a user to grip the tote.

In addition to the location of the integral locking device 400, the device itself may have a different configuration than that of the above-described embodiments. For example, with reference to FIG. 25, the integral locking device 400 may include a driving element 405, a rigid member 402, and a sheath 403 surrounding and fixedly engaging the rigid member. Protrusions 428, 410 may be defined at each end of the sheath 403. The proximal protrusion 428 may connect the rigid member 402 and sheath 403 to the driving element 405, whereas the distal protrusion 410 may act as a locking surface for engaging the engagement surface of the locking slider 206, as shown and described above with respect to FIGS. 18-20, for example. Thus, in such an embodiment, the elongate lock member need not be a relatively long, flexible cable, but may instead be a relatively short, rigid rod for engaging and disengaging the locking slider 206.

In still other embodiments, an integral locking device 500 may be defined as part of the first and second lids 16, 14, as illustrated in FIGS. 26 and 27. In this case, the first lid 16 may define a locking extension 510, and the second lid 14 may define a receiving cavity 520. The locking extension 510 may include a series of notches 554 that are configured to engage a locking spring 552 such that the engaging ends 556 of the locking spring are received, in a locked configuration, into the notches 554 and, thus, prevent the locking extension from being retracted from the receiving cavity 520. In other words, when the locking spring 552 is engaged with the notches 554 of the locking extension 510, the integral locking device 500 is locked and the lids 14, 16 are secured to each other in the closed position.

The engaging ends 556 of the locking spring 552 may comprise magnetic elements (e.g., may be made of or include magnetic materials) that are moveable between a locked position and an unlocked position, and the magnetic elements may be spring biased in the locked position via the locking spring. To unlock the integral locking device 500 of the embodiments of FIGS. 26 and 27, a magnetic key 122 such as the one previously described may be applied to an exterior portion of the second lid 14 to position the magnetic key in magnetic proximity to the magnetic elements and thus attract the engaging ends 556 away from the notches 554 to allow the locking extension 510 to be removed from the receiving cavity 520.

The locking extension 510 may be configured to have some flexibility, such that, as the lids 14, 16 are opened, the locking extension is able to bend as necessary while being removed from the receiving cavity 520 (i.e., due to the arc-like motion of the lids with respect to the body portion of the tote bin). In other words, the locking extension 510 may be configured to flex to accommodate the arcuate joining of the locking extension with the receiving cavity 520 as the respective lids are moved from the open position to the closed position. At the same time, however, the locking extension 510 may be configured to be fully received into the receiving cavity 520 once the end of the locking extension has passed through the opening 521 of the receiving cavity with relative ease (e.g., without the application of an excessive retraction force by the user to push the locking extension into engagement with the receiving cavity). The locking device 500 may be integrally formed on one or both sides of the respective lids 14, 16, as shown in FIG. 26, or a single locking device may be defined in a central portion of the lids (not shown).

In other embodiments, an integral locking device 600 may be provided as shown in FIGS. 28 and 29. The integral locking device 600 in this case may be centrally-located, with a locking plunger 602 integrally molded into the first lid 16 (e.g., the overlapping lid that covers and secures the second lid 14 when the lids are closed). The locking plunger 602 may include a shaft portion 604 and an enlarged portion 610, which may likewise be integrally molded with each other and the lid 16. The enlarged portion 610 may define a locking surface 670 proximate the joining of the shaft portion the enlarged portion comprises the locking surface 604 to the enlarged portion.

Figure 29A:
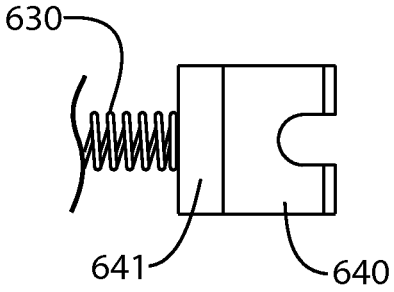
FIG. 29A is a top detail view of the locking shuttle of FIG. 29.

The second lid 14 may in turn define an interior ledge 620 or other lid portion to which a spring 630 and locking shuttle 640 are attached, as shown in FIG. 29. The locking shuttle 640 may define a locking aperture 645 configured to partially surround the shaft portion 604 and engage the locking surface 670, thereby preventing passage of the enlarged portion through the locking aperture in the locked position. For example, the locking aperture 645 may have an arcuate shape, as shown in FIG. 29A, that is configured to substantially match the dimensions of the shaft portion 604. At the same time, the enlarged portion 610 of the plunger 602 may be larger than the locking aperture 645 and may, thus, be secured in a locked position when the shuttle 640 is engaged with the locking surface 670.

The spring 630 may be configured to bias the shuttle 640 into engagement with the plunger 602 (i.e., the locked position). The biasing force of the spring 630, however, may be overcome by the application of a magnetic key 122 to the exterior of the second lid 14. More specifically, the shuttle 640 may be comprised of or may include a magnetic element 641 (in FIG. 29A) that is moveable between the locked position and an unlocked position, such that the shuttle is attracted to and follows the movement of the magnetic key 122, and the magnetic element and shuttle may thus be spring biased in the locked position. The magnetic element 641 may be driven from the locked position to the unlocked position against the spring bias by positioning a magnetic key in magnetic proximity to the magnetic element and moving the magnetic key in the direction of the unlocked position. Thus, by applying the key 122 to the exterior of the lid 14 and moving the key in the direction of the arrow 650, the shuttle 640 is also moved in the direction of the arrow, overcoming the biasing force of the spring 630 and further compressing the spring 630. With the shuttle 630 held in the unlocked position by the magnetic key 122, as shown in FIG. 30, the user is able to open the lids 14, 16 as the locking aperture 645 is no longer restricting the movement of the locking plunger 602.

Once the key 122 is removed, the biasing force of the spring 630 urges the shuttle 640 back into the locked position. When the lids 14, 16 are open, the locking plunger 602 is displaced from the shuttle 640, and the locking aperture 645 cannot engage the plunger. Thus, the shuttle 640 may be configured to allow the enlarged portion 610 of the locking plunger 602 to pass through the locking aperture 645 in one direction (i.e., to engage the plunger with the shuttle as the lids are closed), but not in the other direction (i.e., to disengage the plunger from the shuttle). For example, as shown in FIG. 29, the shuttle 640 may be configured to define a tapered surface, such that as the locking plunger 602 is moved towards the shuttle (i.e., the lids are being closed), the enlarged portion 610 of the plunger can ride along the tapered surface of the shuttle and displace the shuttle, pushing the shuttle towards the unlocked position just enough to clear the shuttle (i.e., the locking aperture 645 of the shuttle) and allow the locking aperture to partially surround the shaft portion and engage the locking surface. Once the enlarged portion 610 is clear of the shuttle 640, the shuttle and locking aperture 645 are moved into engagement with the shaft portion 604 and the locking surface 670, and the lids are thus secured.

Figure 31:
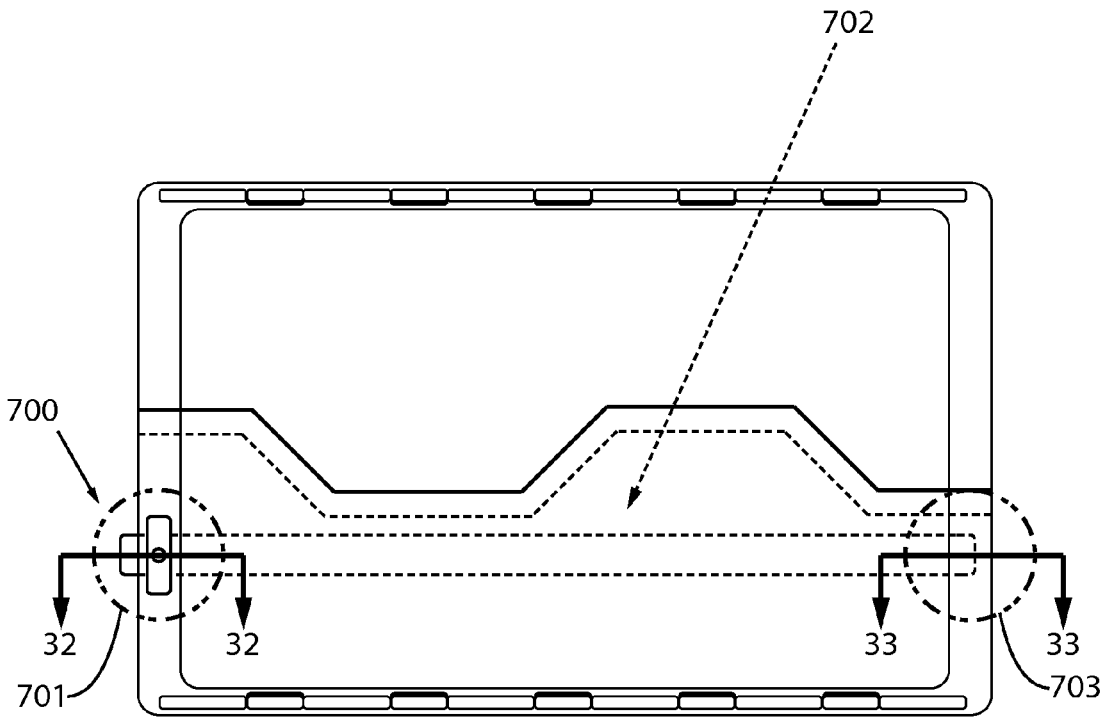
FIG. 31 illustrates a top view of a tote bin with an integral locking device in accordance with another exemplary embodiment.

In still other embodiments, an integral locking device 700 may be provided as shown in FIGS. 31-33B. The integral locking device 700 in this case may be configured to lock one of the lids (i.e., the first lid 16) on two sides of the tote bin to secure both of the lids 14, 16 via a single lock housing 704. In other words, the one lock housing 704, which may be located proximate one of the sides of the tote bin, as shown in FIG. 31, may be configured to control the engagement and disengagement of locking mechanisms at two lock points 701, 703 at either end of the tote bin.

Figure 32B:
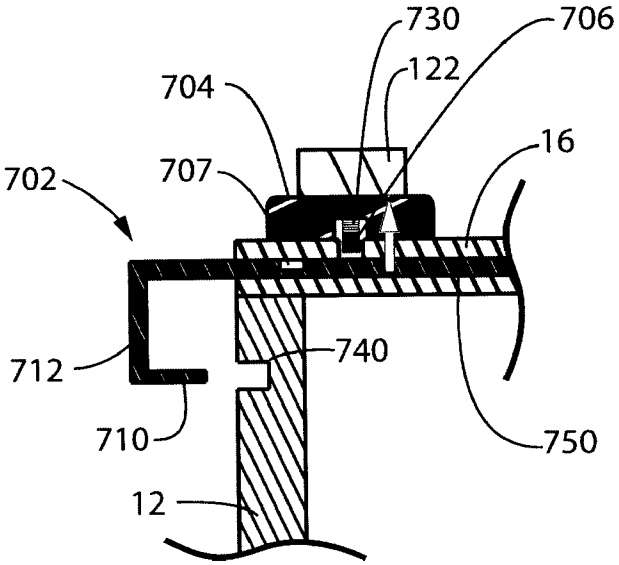
FIG. 32B is a cross-sectional detail view of the locking device of FIG. 32A with the connecting bar extracted.
Figure 32A:
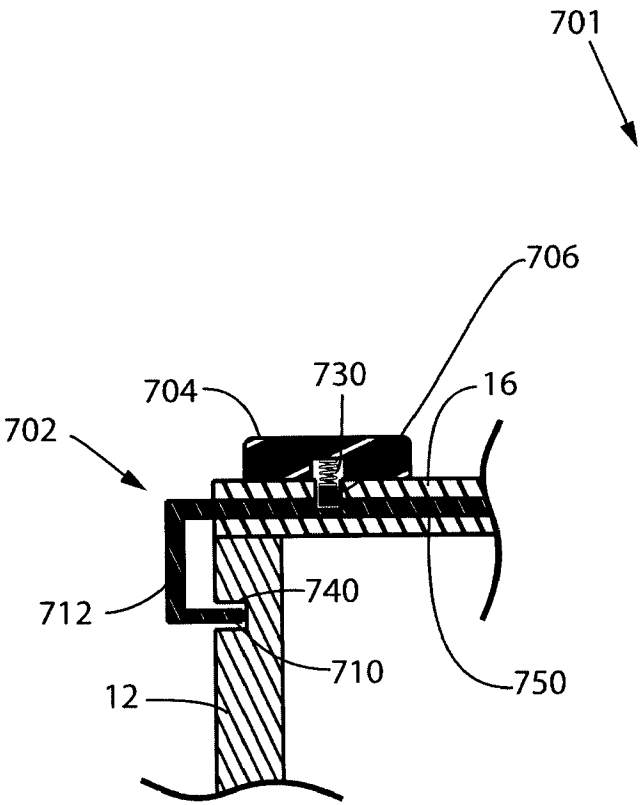
FIG. 32A is a cross-sectional detail view of the locking device of FIG. 31 at a first lock point with the connecting bar retracted.

Referring to FIGS. 31, 32A, and 32B, the integral locking device 700 may include a connecting bar 702, which extends along the lid 16 between two lock points 701, 703. Proximate the first lock point 701, the connecting bar 702 may be configured to have a "U" shape. Thus, at the first lock point 701, the connecting bar 702 may define a first locking portion 710 and grasping portion 712 that the user can grasp to slide the connecting bar 702 into the disengagement position, as described in greater detail below. The body portion 12 of the container may in turn define a first receiving cavity 740 that is configured to receive the first locking portion 710 when the connecting bar 702 is in the locked position, as shown in FIG. 32A. A main portion 750 of the connecting bar 702, from which the grasping portion 712 and first locking portion 710 extend, may slidingly extend through a channel defined in the lid 16 to connect the first lock point 701 with the second lock point 703, as mentioned above.

Figure 33B:
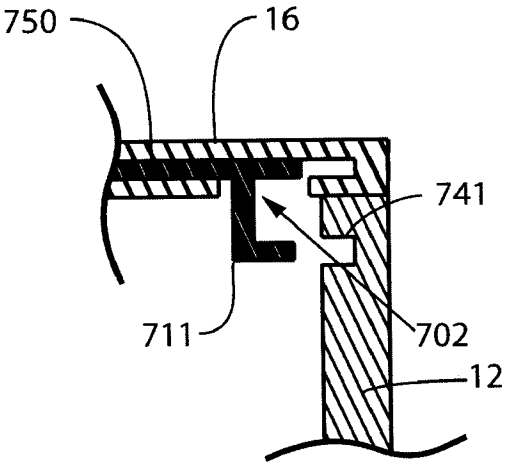
FIG. 33B is a cross-sectional detail view of the locking device of FIG. 33A with the connecting bar extracted.
Figure 33A:
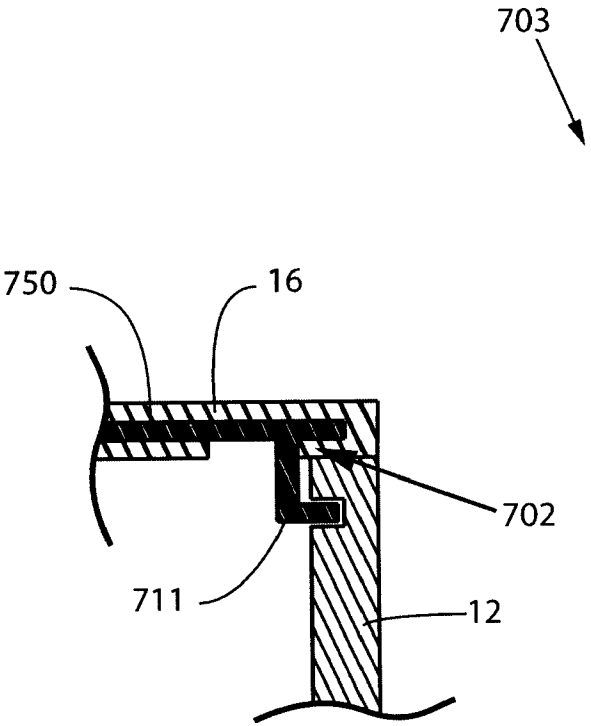
FIG. 33A is a cross-sectional detail view of the locking device of FIG. 31 at a second lock point with the connecting bar retracted.

Turning to FIGS. 33A and 33B, proximate the second lock point 703, the connecting bar 702 may define a second locking portion 711 that is configured to be received in a second receiving cavity 741 defined by the body portion 12 at an opposite end of the tote bin. Thus, whereas the first locking portion 710 is external to the tote bin (i.e., enters the first receiving cavity 740 from outside the tote bin), the second locking portion 711 is internal to the tote bin (i.e., enters the second receiving cavity 741 from inside the tote bin). The second locking portion 711 extends from the main portion 750 of the connecting bar 702, and the lid 16 is configured to allow the sliding movement of the main portion 750 and second locking portion 711 into and out of engagement with the second receiving cavity 741. Thus, only grasping portion 712 may be accessible to the user when the connecting bar 702 is in the retracted position.

Turning again to FIGS. 32A and 32B, the main portion 750 of the connecting bar 702 may define a notch 707 configured to receive the engagement surface of a locking slider 706 similar to the locking sliders of the previously described embodiments. Thus, when the locking slider 706 is received within the notch 707, the connecting bar 702 cannot be moved and is fixed in position. The notch 707 is positioned along the connecting bar 702 such that when the locking slider 706 is received within the notch 707, the first and second locking portions 710, 711 are received by the first and second receiving cavities 740, 741, respectively, and the lid 16 (and, as a result, the underlying lid 14) is secured to the body portion 12 of the tote bin, as shown in FIGS. 32A and 33A. In other words, the tote bin is in the locked configuration.

The locking slider 706 may be attached to a spring 730 within the lock housing 704, and the spring may be configured to bias the locking slider into engagement with the connecting bar 702. The locking slider may include a magnetic element as described above in connection with other embodiments that is moveable between the locked position and an unlocked position, such that the magnetic element may be driven from the locked position to the unlocked position against the spring bias by positioning a magnetic key in magnetic proximity to the magnetic element. Thus, when the tote bin is locked as shown in FIG. 32A, a user may unlock the locking device 700 by applying a magnetic key 122 to the exterior of the lock housing 704 to attract the locking slider 706 out of engagement with the notch 707, thereby allowing the user to grasp the grasping portion 712 and slide the connecting bar 702 to the extracted position such that the first and second locking portions 710, 711 are pulled out of engagement with the first and second receiving cavities 740, 741, as shown in FIGS. 32B and 33B, unlocking the lid 16 from the body portion 12 of the tote. At this point, the lids 14, 16 can be opened and the interior of the tote bin can be accessed.

When the user wishes to secure the tote bin once more, the lids 14, 16 may be closed, and the connecting bar 702 may be pushed from the extracted position to the retracted position via the grasping portion 712. The locking slider 706 may be configured to allow the movement of the connecting bar 702 towards the retracted position even when the magnetic key 122 is not applied and the force of the spring 730 is pushing the locking slider into the connecting bar (e.g., the engagement surface of the locking slider 706 may be tapered). In this way, the user can simply push the connecting bar 702 via the grasping portion 712 until the notch 707 aligns with the locking slider 706 and is engaged, thereby locking both lock points of the tote bin substantially simultaneously.

In one or more of the embodiments discussed above, the locking device may further include anti-theft features configured to provide one or more alerts in the event the locking device on the tote bin is bypassed or the tote bin is moved out of a specified area. For example, the anti-theft features may provide one or more of the following alerts: (1) activation of an alarm (audible and/or visual) at the location of a security gate (i.e., a gate alarm) when the tote bin is physically moved through the security gate; (2) activation of an alarm (audible and/or visual) actually located on or attached to the tote bin when the tote bin is physically moved through the security gate; and (3) activation of an alarm (audible and/or visual) on the tote bin when an attempt has been made to tamper with or bypass the locking device. Details regarding methods and devices for providing such three alarm security are described in U.S. Publication No. 2006/0145848 entitled "Electronic Security Device and System for Articles of Merchandise," U.S. Pat. No. 7,474,209 entitled "Cable Alarm Security Device," and U.S. Pat. No. 7,497,101 entitled "Cable Wrap Security Device," the contents of each of which are incorporated by reference herein.

Figure 34:
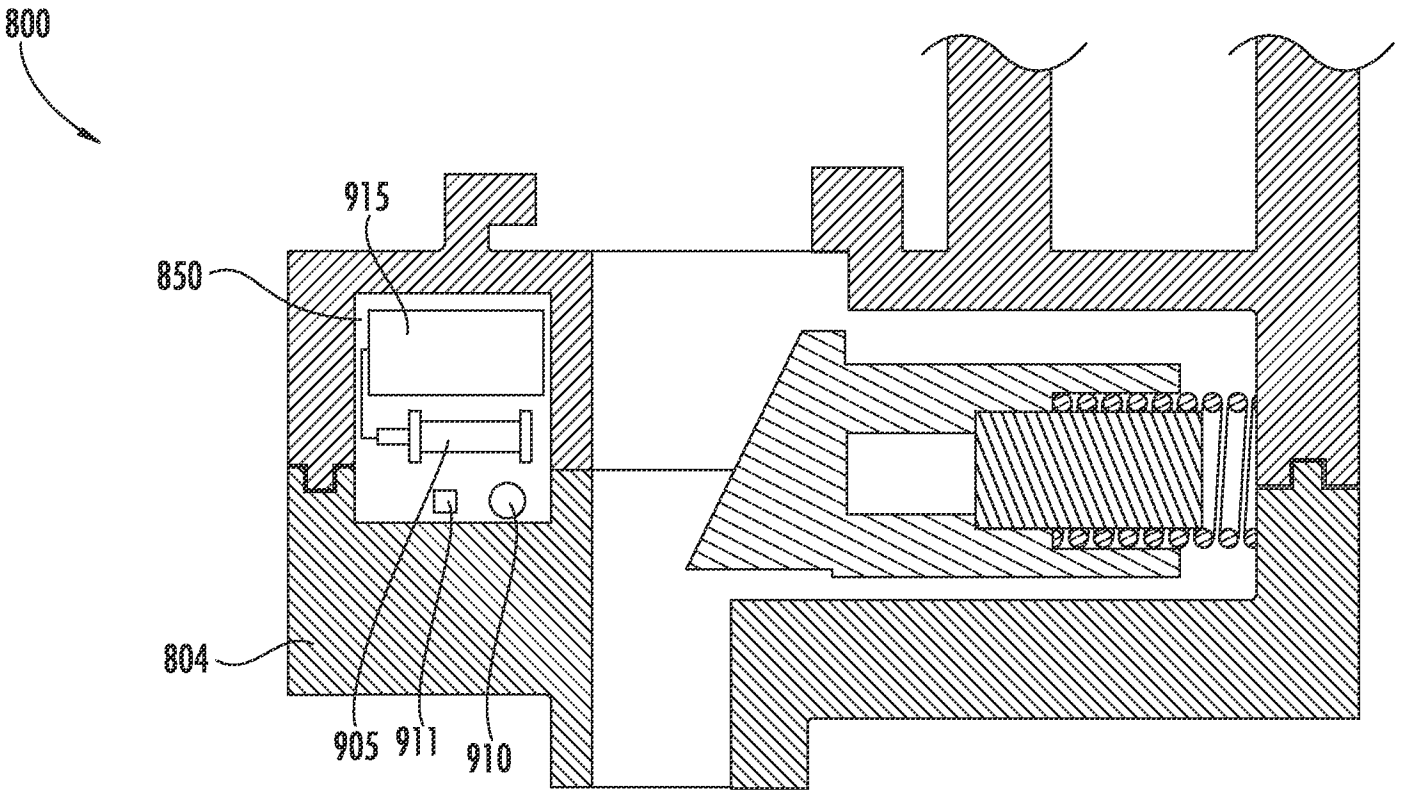
FIG. 34 illustrates a cross-sectional view of a lock housing in accordance with an exemplary embodiment including a security element and alarm components.

With reference to FIG. 34, a locking device 800 (which may be any one of the locking devices described above) is shown as having a lock housing 804 that includes a security element in a chamber 850 of the lock housing 804. The security element may be one of any number of devices that is configured to be detected by a security system such as an RFID transponder (e.g., an active tag, a passive tag, etc.) or an Electronic Article Surveillance (EAS) element. Considering the example of an EAS element 905, shown in FIG. 34, the EAS element may be configured to be detectable when the EAS element is present in a predetermined detection zone, such as a zone set up at or near the door or other entrance point of a warehouse or distribution center. The EAS element may be configured to work within an EAS security system. For example, the EAS element may include a magnetic tag, such as those used in an electromagnetic (EM) system or in an acousto-magnetic (AM) system. As another example, the EAS element may be configured work within a microwave system.

Figure 35:
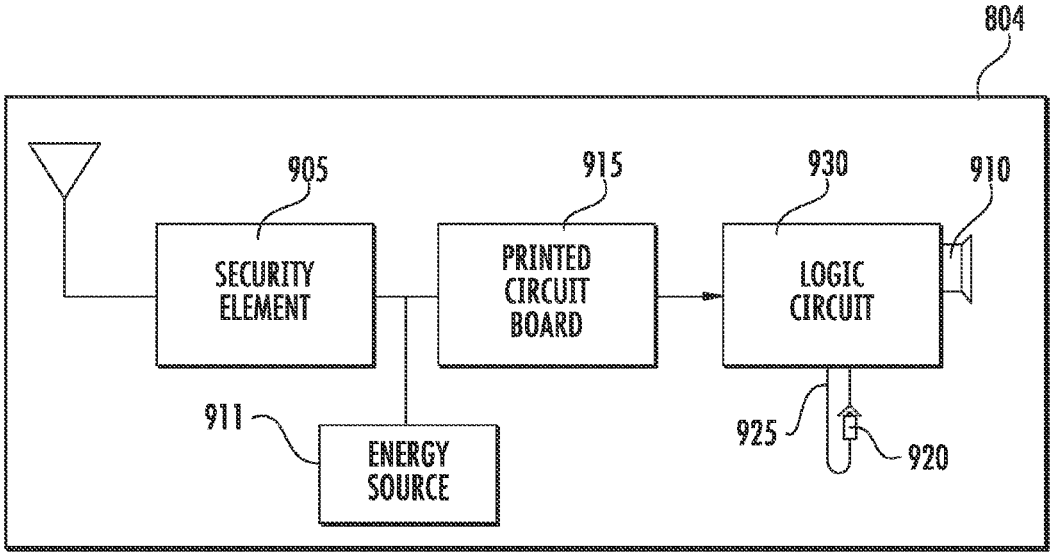
FIG. 35 is a block diagram of the lock housing of FIG. 34.

Referring to FIGS. 34 and 35, in some cases, the lock housing 804 may include other security or alarm features. For example, the lock housing 804 may have an audible alarm device, such as a piezoelectric speaker 910, which may be triggered in response to one or more circumstances. In some embodiments, the lock housing 804 may thus include a printed circuit board 915 with a logic circuit 930, a sense loop 925 configured to detect a fault condition associated with the locking device (i.e., tampering with or bypassing the locking device), and/or an energy source 911, such as a battery. The logic circuit may be disposed in communication with at least a portion of the elongate lock member or other components of the locking device described in various embodiments above to form a sense loop configured to detect a fault condition associated with the locking device 800. In this way, any discontinuity (e.g., cutting of the cable in FIG. 16 or unexpected movement of the latch pin 102 in FIG. 8) in the sense loop may be recognized as a fault condition, which triggers alarm functionality as described in greater detail below.

Thus, according to the embodiments shown in FIGS. 34 and 35, the lock housing 804 may include components that provide 1-alarm (e.g., alarming by a security gate at the security gate when the container is improperly moved past the gate), 2-alarm (e.g., alarming at the security gate when the container is moved and alarming by the locking device at the container when the locking device is tampered with or compromised), or 3-alarm (e.g., alarming at the security gate when the container is moved and alarming by the locking device at the container when the locking device is tampered with or compromised and alarming by the locking device at the container when the container is improperly moved past the security gate) functionality to the container.

Figure 36:
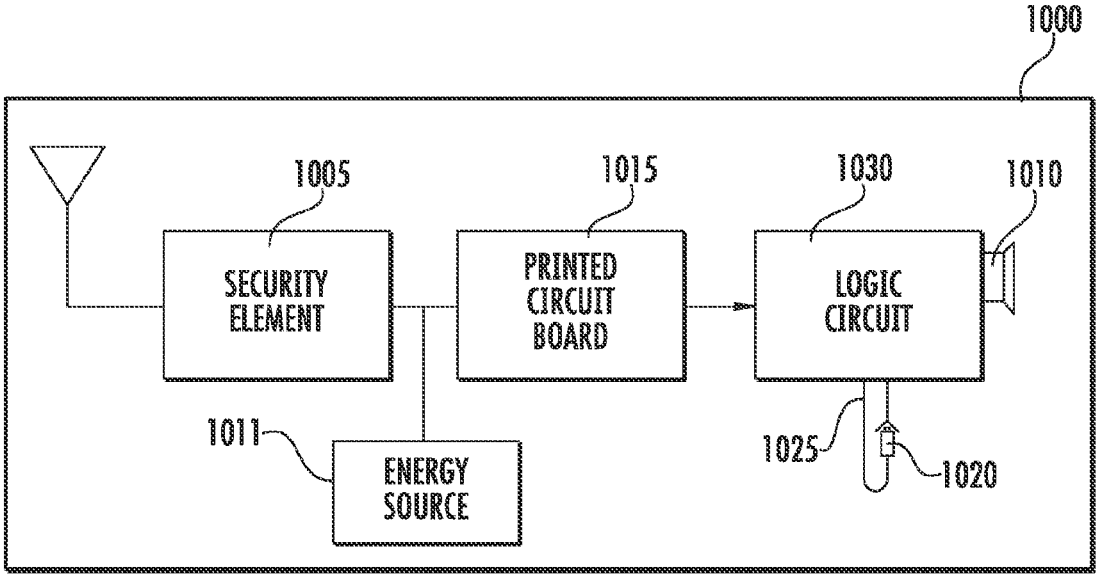
FIG. 36 is a block diagram of a security module device in accordance with an exemplary embodiment.

In other embodiments, it may be desirable to minimize the size of the lock housing and, thus, some components and circuitry necessary to facilitate the above referenced alarm functionality may be housed in a security module 1000. The security module 1000 may be configured to be releasably attached to the lock housing 804. In one embodiment, the security module 1000 may be attached to the outside of the lock housing 804 as shown in FIG. 36.

As will be apparent to one of ordinary skill in the art in view of this disclosure, the security module 1000 may be designed to provide added alarm functionality that might not be desired in a base level or "stock" locking device. For example, in one embodiment, a stock locking device may be equipped simply with an EAS element and, thus, may be capable on its own of only 1-alarm functionality (e.g., triggering an alarm by an EAS gate security gate at the security gate when the locking device is improperly moved past the gate). The security module 1000 may be designed as a complimentary add-on component that is configured to provide 2-alarm (e.g., triggering an alarm by the locking device at the locking device/container when the locking device is tampered with or compromised) and/or 3-alarm functionality (e.g., triggering an alarm by the locking device at the locking device/container when the container is improperly moved past the security gate).

The security module 1000 may include a printed circuit board 1015 that includes a logic circuit 1030 for supporting various functions of the security module. In one embodiment, the logic circuit 1030 may be disposed in communication with at least a portion of the elongate lock member or other components of the locking device described in various embodiments above to form a sense loop configured to detect a fault condition associated with the locking device 800. In this way, a discontinuity (e.g., cutting of the cable in FIG. 16) or change (e.g., unexpected movement of the latch pin 102 in FIG. 8) in the sense loop may be recognized as a fault condition, which triggers alarm functionality.

Figure 37:
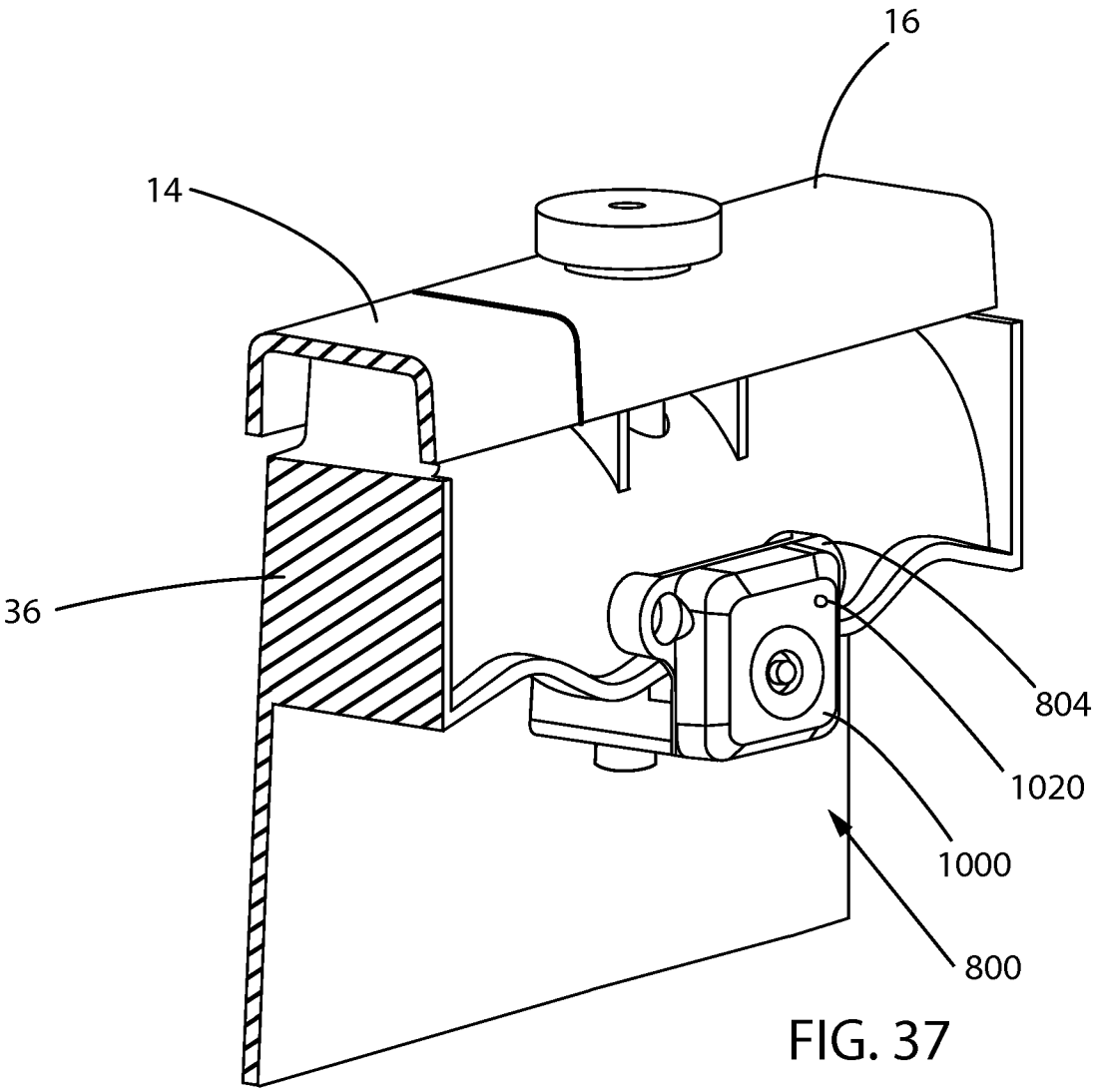
FIG. 37 illustrates a partial side view of the locking device in accordance with an exemplary embodiment including an attached security module.
Figure 38:
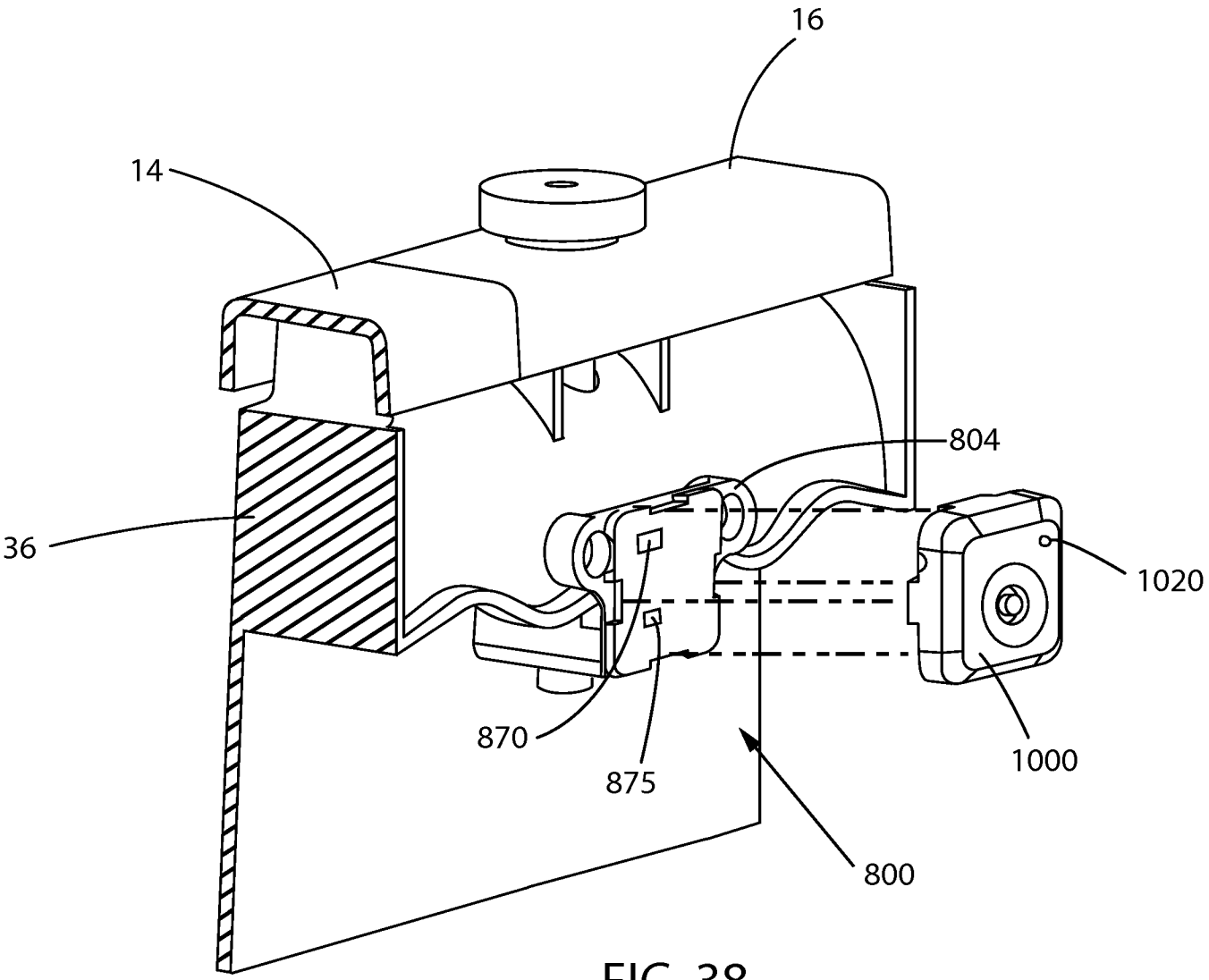
FIG. 38 illustrates a partial side view of the locking device of FIG. 37 with the security module detached.
Figure 39:
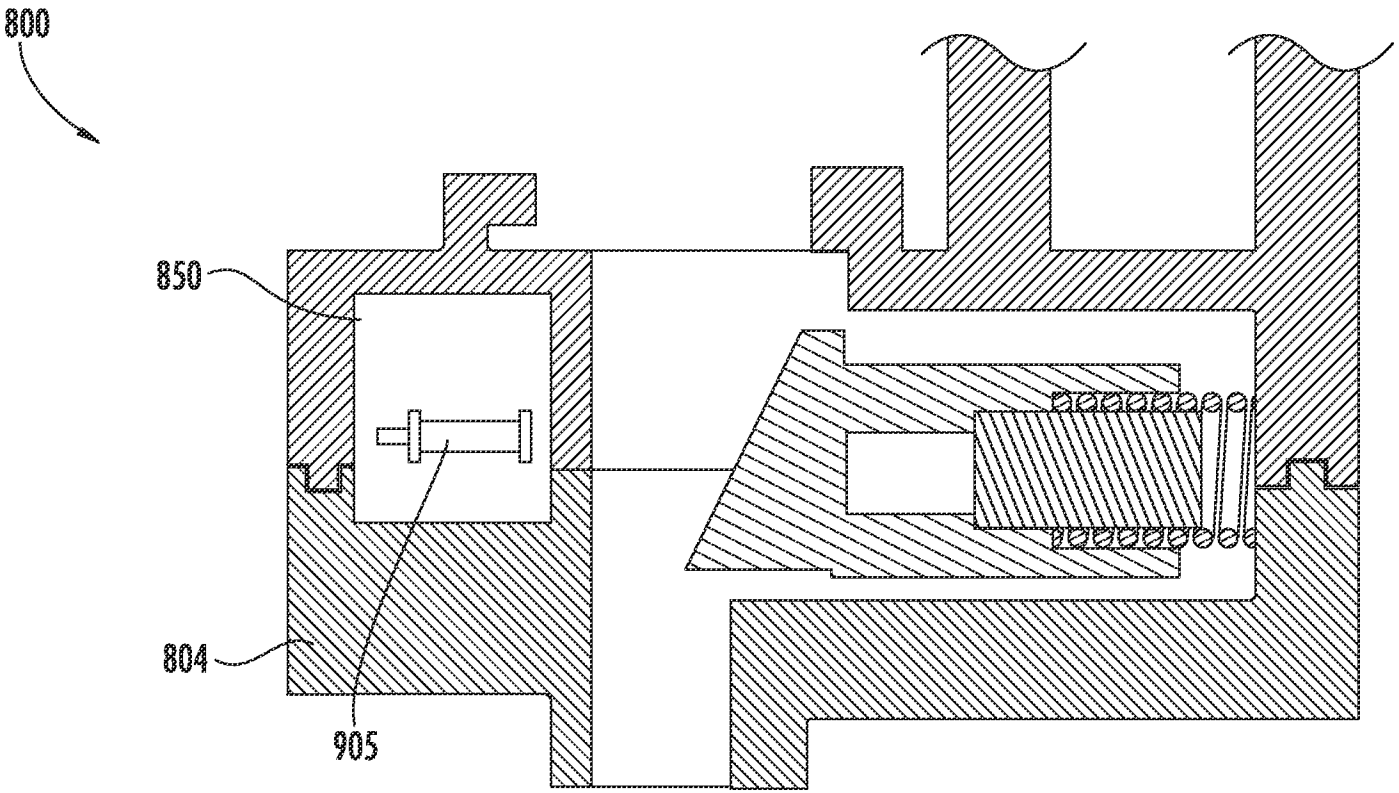
FIG. 39 illustrates a cross-sectional view of a lock housing in accordance with an exemplary embodiment in which the lock housing is to be used in conjunction with a security module.

The security module 1000 may also include a light-emitting diode (LED) 1020, and/or an energy source 1011. In embodiments including an LED, the LED 1020 may be in electrical communication with the logic circuit 1030 of the printed circuit board 1015 and the energy source and may extend at least partially through an opening defined by the exterior of the security module 1000 such that at least a portion of the LED is visible to the user or consumer (as shown in FIGS. 37 and 38). The LED 1020 may be used as an indicator (e.g., by providing a constant light or a blinking on/off light) of the existence of a particular condition or circumstance. For example, the LED 1020 may indicate that the security module 1000 has power, that the locking device 800 is in the locked configuration, that the security module is armed, or that the alarm has been triggered.

As noted above, the alarm components of the lock housing 804 and/or security module 1000 may be configured to activate in the event that a portion of the locking device 800 or security module has been compromised, such as by being cut or damaged. For example, in some embodiments such as those shown and described in connection with FIGS. 12-22, the cable of the locking device may include or may itself be an electrically conductive element and may form a sense loop 925, 1025 in communication with the logic circuit 930, 1030 (e.g., a chip) of the lock housing 804 or security module 1000, as shown in FIGS. 35 and 36. Thus, in event that the cable is compromised, for example, the logic circuit 930, 1030 may be configured to detect the change in the cable and respond by activating the alarm (e.g., directing the speaker 910, 1010 to issue an audible alert).

In some embodiments, the security module 1000 may be deactivated by authorized users in order to transport the tote bin out of the secured area without setting off the alarms. Depending on the particular configuration of the security module 1000, the module may be detached from the lock housing 804, demagnetized, or otherwise neutralized before the tote bin is removed from the designated area.

For example, in FIG. 37, the security module 1000 is releasably attached to the exterior of the lock housing 804, such as via a magnetic connection. When a user does not require the tote bin to have alarm or security capabilities (for example, when the tote bin is empty or otherwise not in use), the security module 1000 may be detached from the housing 804, as shown in FIG. 38, for example, via a magnetic key. In this way, the security module 1000 can be interchangeable among a number of tote bins so as to allow the most efficient use of a limited number of security modules.

In some embodiments, some of the alarm components may be provided in the lock housing 804, whereas other components may be provided in the security module 1000. Thus, with reference to FIGS. 38 and 39, the lock housing 804 may include contacts 870, 875 on an exterior portion of the housing (shown in FIG. 37) that allow alarm components included in the security module 1000 (such as the printed circuit board 1015 and logic circuit 1030) to be in communication with alarm components included in the lock housing (such as the security element 905). In this way, the lock housing 804 may be configured to include only some of the alarm components, for example an EAS element 905, providing limited alarm capabilities to the container (e.g., 1-alarm functionality) on its own, whereas other alarm components, such as the logic circuit 1030, speaker 1010, LED 1020, energy source 1011, etc., may be included in the security module 1000. Thus, the joining of the security module 1000 with the lock housing 804 may form the sense loop 1025 and communicate with the alarm components of the lock housing to provide additional alarm capabilities to the container via the contacts 870, 875, while at the same time allowing the enhanced alarm functionality of the security module to be interchangeable among different containers.

In some cases, the lock housing 804 is configured to include a button (not shown) on the exterior of the housing that is configured to provide additional security functionality. For example, the attachment of the security module 1000 to the lock housing 804 may depress the button, thereby arming the alarm. Thus, unauthorized removal of the security module 1000 (e.g., removing the security module from the lock housing without the magnetic key that serves to disarm the alarm) would cause the button to release, which would be sensed by the logic circuit and trigger an audible or other alarm to alert personnel of the unauthorized activity.

As another example, the logic circuit may be configured to detect when a security element is disposed in alarm proximity to a security gate. In EAS embodiments, the logic circuit may be configured to detect excitation of an EAS element housed within the lock housing or security module. In RFID embodiments, the logic circuit may be configured to detect a power up condition or signal generated by an RFID transponder housed within the lock housing or security module. Upon such detection, the logic circuit may be configured to initiate an alarm (e.g., audio alarm, visual alarm, or send a signal to a remote network entity or server).

In one embodiment, a speaker 910, 1010 may be housed within the lock housing 804 and/or security module 1000. Thus, when unauthorized movement of the locking device is detected, an audible alarm may be triggered by the locking device at the locking device in addition to any audible alarm that may be triggered at the security gate. In this way, personnel may be able to locate the tote bin as it is transported away from the secured area, thereby facilitating the recovery of the stolen goods.

In other embodiments, various other alarm indicators may be provided by the locking device and/or security gate. For example, each may further include components for providing visual alerts (e.g., LED indicators, strobe lights, high intensity lights, etc.) along with the audible alerts provided by the respective speakers. The locking device and/or security gate may further be configured with circuitry and communication components (i.e., wireless radio, etc.) for sending an alert signal to a remote network entity (i.e., controller or server).

As mentioned above, the security element 905 may include various types of wireless devices including RFID transponders or tags. Such RFID tags may be used to store and/or communicate information about objects stored in the tote bins for security or inventory control purposes. In some embodiments, a locking device structured in accordance with various embodiments may include a configurable monitoring device (supported in the lock housing or as an attached security module) as described in commonly owned U.S. Provisional Application Nos. 61/244,320, 61/246,388, and 61/248,223, which are incorporated by reference herein in their entirety. Such configurable monitoring device equipped locking devices are referred to herein as "tote CMDs" and may be used for locating the tote for inventory control and security purposes. The tote CMDs may also be configured to detect the presence of RFID tags (e.g., passive or active) and associated products within the tote. Thus, a tote CMD may operate similar to a node, with respect to the RFID tags stored within the tote. A tote CMD configured to operate as a node may therefore enable communication with nearby RFID tags, detection of the presence of nearby RFID tags, tracking of nearby RFID tags, relaying of configuration information to RFID tags or other nodes, and other functions. Tote CMDs may also be configured to communicate with other nodes provided at various other strategic locations (for example, within a warehouse environment) in which the presence of a CMD (and its corresponding product) should be noted, monitored or tracked.

In some embodiments, the tote CMDs may maintain an inventory of the products within the tote by virtue of communication with each respective tagged product in the tote and the extraction and/or storage of product related information associated with each respective tag. For example, as the tote moves from the warehouse to a destination store, the inventory information may be verified at both locations to ensure that the contents of the tote have not been tampered with or stolen. Furthermore, after acceptance of the tote and verification of the contents of the tote, an entirety of the contents of the tote may automatically be uploaded into the inventory of the receiving store.

The tote CMD may also interface with a key, such as a manager's key. In this regard, the key may be enabled to deactivate security functionality of the tote tag, such as the alarm functionality discussed above. The tote CMD may be configured to alarm if an attempt is made to open the tote without the key or with an unapproved key. The tote CMD may also alarm if communication is lost with the tag of one or more of the tagged products within the tote. A key may be configured to interface with the tote CMD, either directly or through the monitoring system, to deactivate, or activate, the tote tag's alarming functionality. The monitoring system, or the tote CMD may be configured to manage access to the contents of the tote by, for example, maintaining a list identifying the particular keys or the types of keys (e.g., high level manager's key) that have been enabled to open the tote. In the event that an unapproved key is used, or is attempted to be used, for opening a tote, the tote CMD may alarm. In some cases, the manager's key may also include a physical or electronic key capable of opening the actual tote locking device 800 that secures the tote. An example of a key device can be found in commonly owned U.S. Provisional Application No. 61/248,269, which is incorporated by reference herein in its entirety.

For example, a special authorization code, called a tote code, may be assigned to the tote. Before the tote is shipped from a first location (such as a distributor or manufacturer) to a second location (such as a retail store), the tote code can be used to lock the tote CMD affixed thereto. Upon arrival at the second location, the tote may not be opened like other tote CMDs or locking devices. For example, the manager's key may not be able to decommission and unlock the tote CMD, even if the manager's key has the highest level of authorization. Rather, the manager's key may need to be dynamically updated with the appropriate tote code. The tote code can be passed via a public Internet, closed network, flash memory drive, or by any other electronic means. Similarly, if the tote code is a series of numbers and letters, the first location manager can telephone the second location manager and verbally deliver the tote code. The second location manager may then enter the tote code into his already activated manager's key and use the manager's key to decommission and unlock the tote.

Many modifications and other embodiments of the invention set forth herein will come to mind to one skilled in the art to which the invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A locking device for locking a container having sidewalls and at least one lid defining an open position and a closed position, the locking device comprising:

an elongate lock member comprising a flexible cable, the elongate lock member being configured to engage one of the at least one lid or at least one of the sidewalls, the elongate lock member being configured to travel between a retracted position and an extracted position;

a lock housing associated with the other of the at least one lid or the at least one of the sidewalls, wherein the lock housing is configured to at least partially receive the elongate lock member, and wherein the lock housing comprises a lock assembly configured to lockably engage the elongate lock member and secure the at least one lid in the closed position; and a guide element fixedly disposed to the lock housing, the guide element being configured to direct the flexible cable in a substantially linear direction towards the lock housing as the flexible cable is driven from the extracted position to the retracted position, wherein the entire flexible cable is maintained in a substantially linear form when the elongate lock member is lockably engaged with the lock assembly.

2. The locking device of claim 1, further comprising a security element selected from the group consisting of an RFID transponder and an EAS element.

3. The locking device of claim 1, wherein the lock housing further comprises an audible alarm device and an energy source.

4. The locking device of claim 1, wherein the lock housing further comprises an audible alarm device, an energy source, and a sense loop configured to detect a fault condition associated with the locking device.

5. The locking device of claim 1 further comprising a security module configured to be releasably attached to the lock housing, wherein the security module comprises an audible alarm device and an energy source.

6. The locking device of claim 1 further comprising a security module configured to be releasably attached to the lock housing, wherein the security module comprises an audible alarm device, an energy source, and a logic circuit disposed in communication with at least a portion of the elongate lock member to form a sense loop configured to detect a fault condition associated with the locking device.

7. The locking device of claim 1, wherein the elongate lock member is configured to engage the at least one lid, and the lock housing is securely fastened to the at least one of the sidewalls.

8. The locking device of claim 7, wherein the container defines a handle, and wherein the lock housing is securely fastened to the at least one of the sidewalls proximate the handle.

9. The locking device of claim 1, wherein the elongate lock member is configured to engage the at least one lid, and wherein the at least one of the sidewalls at least partially forms the lock housing.

10. The locking device of claim 1, wherein the elongate lock member defines a locking surface, and wherein the lock assembly comprises a locking slider that is spring biased to engage a locking surface of the elongate lock member.

11. The locking device of claim 1, wherein the flexible cable of the elongate lock member defines a locking surface, and wherein the lock assembly is configured to engage the locking surface of the flexible cable when the lock assembly is in a locked position.

12. The locking device of claim 11, wherein the lock assembly is configured to engage the locking surface of the flexible cable when the flexible cable is in the retracted position.

13. The locking device of claim 12, wherein a retraction force is required to drive the flexible cable from the extracted position to the retracted position.

14. The locking device of claim 13, wherein the flexible cable defines a driving element configured to be grasped by a user when applying the retraction force.

15. The locking device of claim 13, wherein the at least one lid comprises a cable retaining element configured to frictionally resist movement of the flexible cable from the extracted position to the retracted position.

16. The locking device of claim 13, wherein the flexible cable defines a drive rigidity for reducing buckling of the flexible cable when the retraction force is applied.

17. The locking device of claim 1, wherein the container comprises a first lid and a second lid, and wherein the elongate lock member is configured to engage and secure the first lid and the second lid in the closed position when the lock assembly is in the locked position.

18. The locking device of claim 1, wherein the container comprises a first lid and a second lid, and wherein the elongate lock member is configured to engage and secure the first lid and the second lid in the closed position when the lock assembly is in a locked position.

19. The locking device of claim 18, wherein the elongate lock member is configured to remain with the first lid when the elongate lock member is in an extracted position and the first lid is in the open position.

20. A locking device for locking a container having sidewalls and at least one lid defining an open position and a closed position, the locking device comprising:

a flexible cable configured to engage the at least one lid and defining a locking surface, the flexible cable being configured to travel between a retracted position and an extracted position;

a lock housing associated with at least one of the sidewalls, wherein the lock housing is configured to at least partially receive the flexible cable, wherein the lock housing comprises a locking slider defining a locked position and having an engagement surface, wherein the engagement surface is configured to engage the locking surface of the flexible cable and secure the at least one lid in the closed position when the locking slider is in the locked position; and a guide element fixedly disposed to the lock housing, the guide element being configured to direct the flexible cable in a substantially linear direction towards the lock housing as the flexible cable is driven from the extracted position to the retracted position, wherein the entire flexible cable is maintained in a substantially linear form when the locking surface of the flexible cable is lockably engaged with the engagement surface of the locking slider.

21. The locking device of claim 20, further comprising a security element selected from the group consisting of an RFID transponder and an EAS element.

22. The locking device of claim 20, wherein the lock housing further comprises an audible alarm device and an energy source.

23. The locking device of claim 20, wherein the lock housing further comprises an audible alarm device, an energy source, and a sense loop configured to detect a fault condition associated with the locking device.

24. The locking device of claim 20 further comprising a security module configured to be releasably attached to the lock housing, wherein the security module comprises an audible alarm device and an energy source.

25. The locking device of claim 20 further comprising a security module configured to be releasably attached to the lock housing, wherein the security module comprises an audible alarm device, an energy source, and a logic circuit disposed in communication with at least a portion of the elongate lock member to form a sense loop configured to detect a fault condition associated with the locking device.

26. The locking device of claim 20, wherein the locking surface comprises at least one ferrule configured to engage the engagement surface of the locking slider.

27. The locking device of claim 20, wherein the locking slider comprises a magnetic element that is moveable between the locked position and an unlocked position, and wherein the magnetic element is spring biased in the locked position.

28. The locking device of claim 27, wherein the magnetic element may be driven from the locked position to the unlocked position against the spring bias by positioning a magnetic key in magnetic proximity to the magnetic element.

29. The locking device of claim 20, wherein the engagement surface of the locking slider is configured to engage the locking surface of the flexible cable when the flexible cable is in the retracted position.

30. The locking device of claim 29, wherein a retraction force is required to drive the flexible cable from the extracted position to the retracted position.

31. The locking device of claim 30, wherein the flexible cable defines a driving element configured to be grasped by a user when applying the retraction force.

32. The locking device of claim 30, wherein the flexible cable defines a drive rigidity for reducing buckling of the flexible cable when the retraction force is applied.

33. The locking device of claim 20, wherein the guide element is fixedly disposed within the at least one sidewall associated with the locking housing and at least partially surrounding the flexible cable when the flexible cable is in the retracted position.

34. The locking device of claim 20, wherein the guide element is configured to shield at least part of the flexible cable when the flexible cable is in the retracted position.

35. The locking device of claim 20, wherein the at least one lid comprises a cable retaining element configured to frictionally resist movement of the flexible cable from an extracted position to a retracted position.

36. The locking device of claim 20, wherein the container comprises a first lid and a second lid, and wherein the flexible cable is configured to engage and secure the first lid and the second lid in the closed position when the locking slider is in the locked position.

37. The locking device of claim 20, wherein the lock housing is securely fastened to the at least one of the sidewalls.

38. The locking device of claim 37, wherein the container defines a handle, and wherein the lock housing is securely fastened to the at least one of the sidewalls proximate the handle.

39. The locking device of claim 20, wherein the at least one of the sidewalls at least partially forms the lock housing.

* * * * *